US010029881B2

(12) United States Patent
Okamoto et al.

(10) Patent No.: US 10,029,881 B2
(45) Date of Patent: Jul. 24, 2018

(54) MEDIUM PROCESSING DEVICE AND MEDIUM TRANSACTION DEVICE

(71) Applicant: Oki Electric Industry Co., Ltd., Tokyo (JP)

(72) Inventors: Masaaki Okamoto, Tokyo (JP); Madoka Wakabayashi, Tokyo (JP); Satoru Iwasaki, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 15/327,409

(22) PCT Filed: Jun. 15, 2015

(86) PCT No.: PCT/JP2015/067213
§ 371 (c)(1),
(2) Date: Jan. 19, 2017

(87) PCT Pub. No.: WO2016/038963
PCT Pub. Date: Mar. 17, 2016

(65) Prior Publication Data

US 2017/0309133 A1 Oct. 26, 2017

(30) Foreign Application Priority Data

Sep. 11, 2014 (JP) ..... 2014-185323

(51) Int. Cl.
*B65H 29/58* (2006.01)
*B65H 43/04* (2006.01)
(Continued)

(52) U.S. Cl.
CPC ..... *B65H 43/04* (2013.01); *B65H 29/58* (2013.01); *B65H 29/60* (2013.01); *B65H 29/62* (2013.01);
(Continued)

(58) Field of Classification Search
CPC ..... B65H 29/58; B65H 29/60; B65H 29/62; B65H 31/24; B65H 43/04; B65H 2408/11;
(Continued)

(56) References Cited

U.S. PATENT DOCUMENTS

2002/0180136 A1 12/2002 Amari et al.
2010/0174403 A1* 7/2010 Takeuchi ..... G06Q 20/382 700/215
(Continued)

FOREIGN PATENT DOCUMENTS

JP H09-223256 A 8/1997
JP 2002-099941 A 4/2002
(Continued)

*Primary Examiner* — David H Bollinger
(74) *Attorney, Agent, or Firm* — Rabin & Berdo, P.C.

(57) ABSTRACT

The present invention provides a medium processing device and medium transaction device that may increase stability by shortening a conveyance path. Namely, a banknote deposit/withdrawal device includes a conveyance section that forms a linear conveyance path along a front-rear direction inside an upper section block, in the vicinity of a boundary with a lower section block. An upper section storage box is disposed in the vicinity of a rear side terminal end of a rear conveyance section. Counterfeit notes are conveyed to the upper section storage box using a switching section. Accordingly, due to keeping the conveyance path length short, the banknote deposit/withdrawal device may reduce the frequency of occurrence of faults, such as banknote jams, and may prevent the circulation of counterfeit notes by storing counterfeit notes segregated from genuine banknotes, reject banknotes, and the like.

8 Claims, 13 Drawing Sheets

(51) Int. Cl.
*B65H 29/60* (2006.01)
*B65H 29/62* (2006.01)
*B65H 31/24* (2006.01)

(52) U.S. Cl.
CPC ..... *B65H 31/24* (2013.01); *B65H 2402/10* (2013.01); *B65H 2408/11* (2013.01); *B65H 2408/111* (2013.01); *B65H 2408/13* (2013.01); *B65H 2511/40* (2013.01)

(58) Field of Classification Search
CPC ..... B65H 2408/111; B65H 2408/13; B65H 2511/40; B65H 2402/10
USPC ..... 209/534; 271/298, 299, 303, 305
See application file for complete search history.

(56) References Cited

U.S. PATENT DOCUMENTS

2013/0220897 A1* 8/2013 Asada ..... G07D 11/00 209/534
2013/0307210 A1* 11/2013 Takada ..... B65H 5/26 271/3.19

FOREIGN PATENT DOCUMENTS

JP 2006-085736 A 3/2006
JP 2011-018252 A 1/2011
JP 2011-146018 A 7/2011

* cited by examiner

MEDIUM PROCESSING DEVICE AND MEDIUM TRANSACTION DEVICE

TECHNICAL FIELD

The present invention relates to a medium processing device and a medium transaction device, for example a medium processing device and a medium transaction device that may be applied to an Automatic Teller Machine (ATM) into which a paper sheet shaped medium such as banknotes is inserted, and that performs desired transactions.

BACKGROUND ART

Generally, ATMs employed in financial institutions and the like performs various transactions according to the contents of a transaction with a customer, for example deposit transactions in which a customer deposits in cash such as banknotes or coins, or withdrawal transactions in which cash is withdrawn to the customer. One type of ATM is known as a re-cycling type (or recirculating type), in which banknotes deposited by a customer in one transaction are reused and withdrawn to another customer in a subsequent transaction.

Some re-cycling type ATMs are installed with a banknote deposit/withdrawal device that performs, for example, processing relating to banknote deposit and withdrawal. Such a banknote deposit/withdrawal device includes, for example, a deposit/withdrawal section (deposit/withdrawal port) that exchanges banknotes with a customer, a conveyance section that conveys banknotes, a verification section (banknote determination section) that verifies inserted banknotes by denomination and authenticity, a temporary holding section (temporary safekeeping box) that temporarily holds inserted banknotes, and banknote storage boxes that store banknotes. The banknote deposit/withdrawal device further includes a reject box that stores reject banknotes that have been verified as unsuitable for re-use by the verification section (for example, Japanese Patent Application Laid-Open (JP-A) No. 2006-85736 (FIG. 3)).

SUMMARY OF INVENTION

Technical Problem

In conventional deposit/withdrawal devices, for example, a conveyance path is formed so as to link together the deposit/withdrawal section, the verification section, and the temporary holding section at the upper side of a casing, and a conveyance path linking plural of the banknote storage boxes is formed at the lower side of the casing. In such deposit/withdrawal device, in particular at the upper side of the casing, paths are formed connecting the deposit/withdrawal section and the lower side of the casing to one end side of the verification section, and connecting the temporary holding section to the other end side of the verification section. Moreover, the reject box is connected to the conveyance path at the other end side of the verification section at the upper side of the casing, or to the conveyance path at the lower side of the casing.

Namely, in the conventional deposit/withdrawal devices, a comparatively long conveyance path is formed in order to sequentially perform the necessary transaction processing. In conventional deposit/withdrawal devices, the conveyance paths have complex configurations with a large number of configuration components, thereby increasing the likelihood of faults, and thus giving rise to the need for maintenance operations.

The present invention provides a medium processing device and a medium transaction device that has increased stability due to shortening the conveyance path.

Solution to Problem

A first aspect of the present invention is a medium processing device including: an input/output section that inputs and outputs a paper sheet shaped medium; a first conveyance section, connected to the input/output section, that conveys the medium along a first conveyance path; a verification section that includes an internal verification conveyance section to convey the medium between both ends of the verification section, that is connected to the first conveyance section at one end of the verification conveyance section, and that verifies the medium conveyed by the verification conveyance section; a second conveyance section, connected to another end of the verification conveyance section, that conveys the medium along a second conveyance path; a storage switching section, provided at the second conveyance section, that switches a conveyance path of the medium; a medium storage box, connected to the second conveyance section via the storage switching section, that stores the medium; a segregation switching section, provided at the second conveyance section, that switches a conveyance path of the medium; a segregation storage box, connected to the second conveyance section via the segregation switching section, that stores a segregated medium determined by the verification section to be a medium that should be segregated from the medium stored in the medium storage box; and a controller that controls a conveyance path of the medium by the first conveyance section and the second conveyance section by using a verification result of the verification section.

A second aspect of the present invention is a medium transaction device including: a casing that includes an opening; a door that opens and closes the opening of the casing; a movable unit that is stowed inside the casing or is pulled out through the opening to the exterior; an input/output section, provided at the movable unit, that inputs and outputs a paper sheet shaped medium; a first conveyance section, provided at the movable unit, that is connected to the input/output section, and that conveys the medium along a first conveyance path; a verification section, provided at the movable unit, that includes an internal verification conveyance section to convey the medium between both ends of the verification section, that is connected to the first conveyance section at one end of the verification conveyance section, and that verifies the medium conveyed by the verification conveyance section; a second conveyance section, provided at the movable unit, that is connected to another end of the verification conveyance section, and that conveys the medium along a second conveyance path; a storage switching section, provided at the second conveyance section, that switches a conveyance path of the medium; a medium storage box, connected to the second conveyance section via the storage switching section, that stores the medium; a segregation switching section, provided at the second conveyance section, that switches a conveyance path of the medium; a segregation storage box, provided at the movable unit, that is connected to the second conveyance section via the segregation switching section, and that stores a segregated medium verified by the verification section as requiring segregation from the medium stored in the medium storage box; and a controller that controls a conveyance path of the medium by the first conveyance section and the second conveyance section by using a verification result of the verification section, wherein the segregation storage box is detachably attached to the movable unit, and is suppressed from being separated from the movable unit in a state in which the movable unit is stowed inside the casing.

In the above aspects of the present invention, the input/output section is connected to the first conveyance section that is connected to the one end of the verification section, and the medium storage box and the segregation storage box are connected to the second conveyance path that is connected to the other end of the verification section. The above aspects of the present invention thereby may enable the conveyance path to be made simpler, with a shorter overall length, than the conventional deposit/withdrawal devices, and may perform similar processing on the medium as the conventional deposit/withdrawal devices.

Advantageous Effects of Invention

According to the above aspects, the present invention may provide a medium processing device and a medium transaction device that may increase stability due to shortening the conveyance path.

DESCRIPTION OF EMBODIMENTS

Explanation follows regarding embodiments (referred to below as exemplary embodiments) of the present invention, with reference to the drawings.

1. First Exemplary Embodiment

1-1. Overall ATM Configuration

Figure 1:
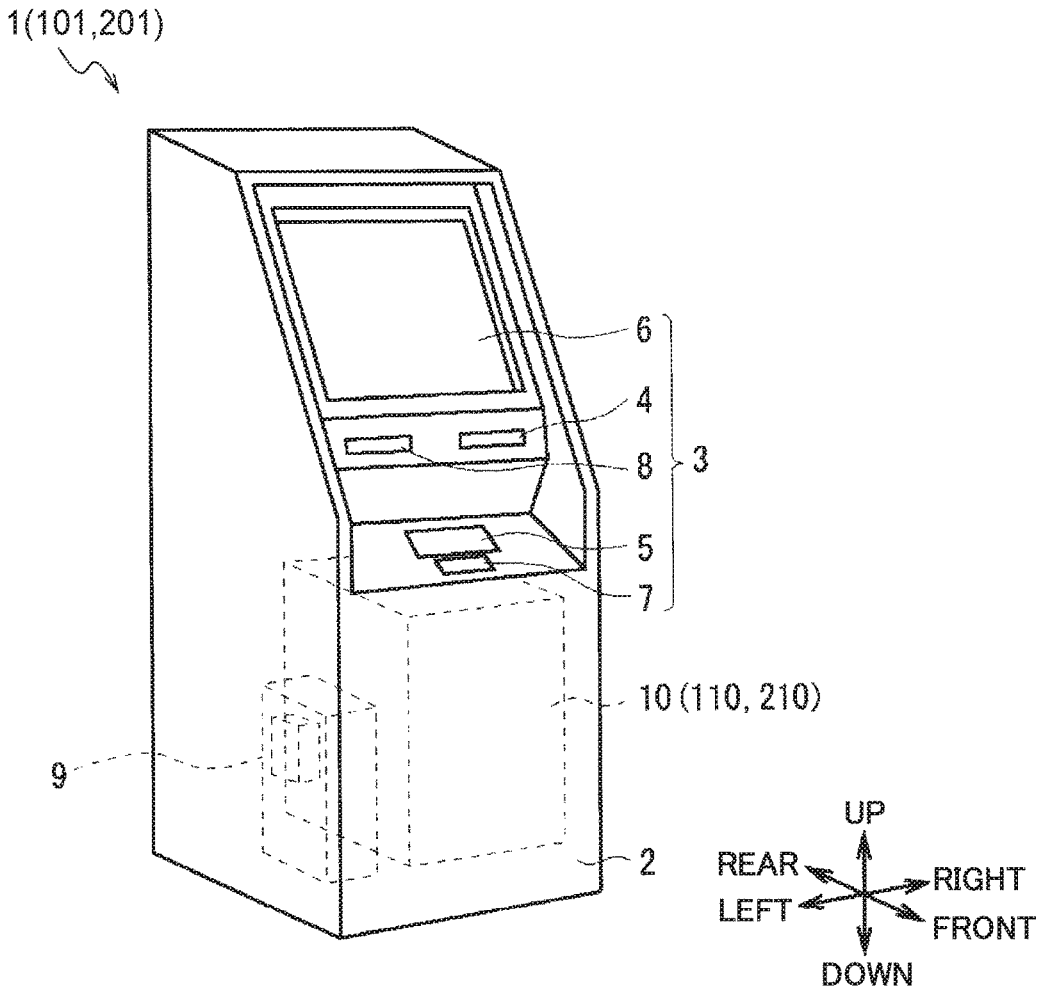
FIG. 1 is a schematic perspective view illustrating overall configuration of an ATM.

As illustrated in the external view of FIG. 1, an ATM 1 includes a box shaped casing 2, and is installed, for example, in a financial institution to perform cash transactions such as deposit processing and withdrawal processing with a customer.

The casing 2 includes a customer interface 3 at a location enabling easy banknote insertion, easy operation of a touch panel, and the like by a customer facing the front side of the casing 2. The customer interface 3, for example, directly handles cash and card transactions with the customer, and notifies transaction-related information and receives operation instructions. The customer interface 3 is provided with a card insertion/removal port 4, a deposit/withdrawal port 5, an operation and display section 6, a ten-key 7, and a receipt issue port 8.

The card insertion/removal port 4 is a section where various cards, such as cash cards, are inserted and returned. A card processor (not illustrated in the drawings) that reads, for example, account numbers magnetically recorded on the various cards is provided behind the card insertion/removal port 4. The deposit/withdrawal port 5 is a section where banknotes are inserted by a customer, and where banknotes are dispensed to a customer. The deposit/withdrawal port 5 is opened and closed by driving a shutter. Note that banknotes, serving as a medium, are for example configured from rectangular shaped paper.

The operation and display section 6 is a touch panel integrating a Liquid Crystal Display (LCD) that displays operation screens during transactions, and a touch sensor that is input with, for example, a transaction type selection, a PIN, or a transaction amount. The ten-key 7 is a physical keypad that is input with, for example, the numbers 0 to 9. The ten-key 7 is employed during PIN and transaction amount input operations and the like. The receipt issue port 8 is a section that issues a receipt printed with transaction details and the like at the end of transaction processing. A receipt processor (not illustrated in the drawings) that prints transaction details and the like on a receipt is provided at the back of the receipt issue port 8.

In the following explanation, the front side is defined as the side of the ATM 1 that a customer faces, and the opposite side thereto is defined as the rear side. The left side, right side, upper side and lower side are respectively defined from the perspective of the left and right as seen by a customer facing the front side.

A main controller 9 that performs general control of the overall ATM 1, a banknote deposit/withdrawal device 10 that performs various processing relating to banknotes, and the like, are provided inside the casing 2. The main controller 9 is configured around a Central Processing Unit (CPU) (not illustrated in the drawings). The main controller 9 reads and executes specific programs from ROM, flash memory, or the like to perform various processing such as deposit processing and withdrawal processing. The main controller 9 is provided with an internal storage section including Random Access Memory (RAM), a hard disk drive, flash memory, or the like. The storage section is stored with various information.

Figure 2A:
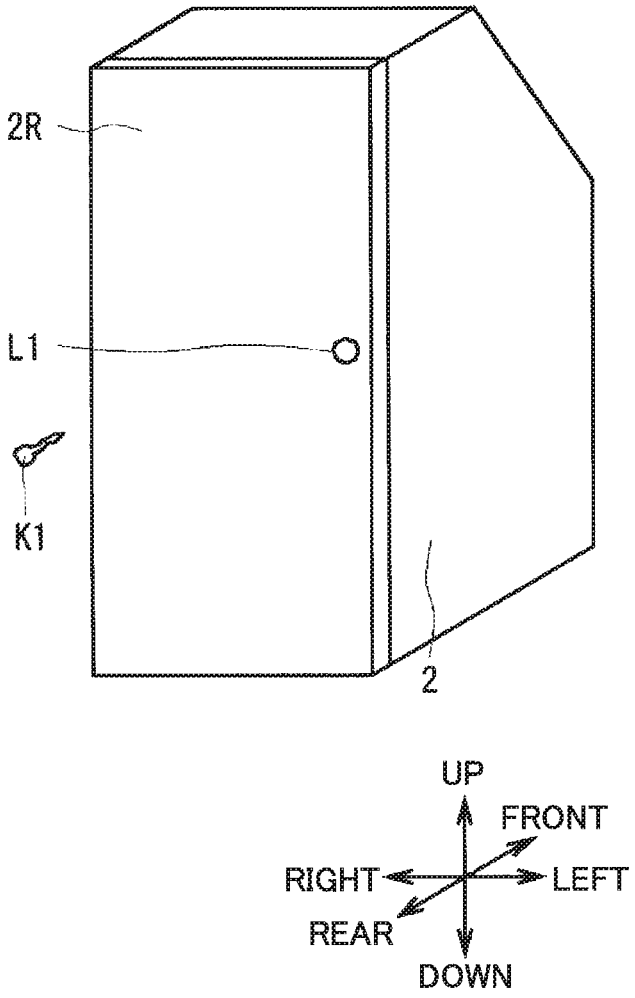
FIG. 2A is a schematic view illustrating opening and closing of a rear door of an ATM.
Figure 2B:
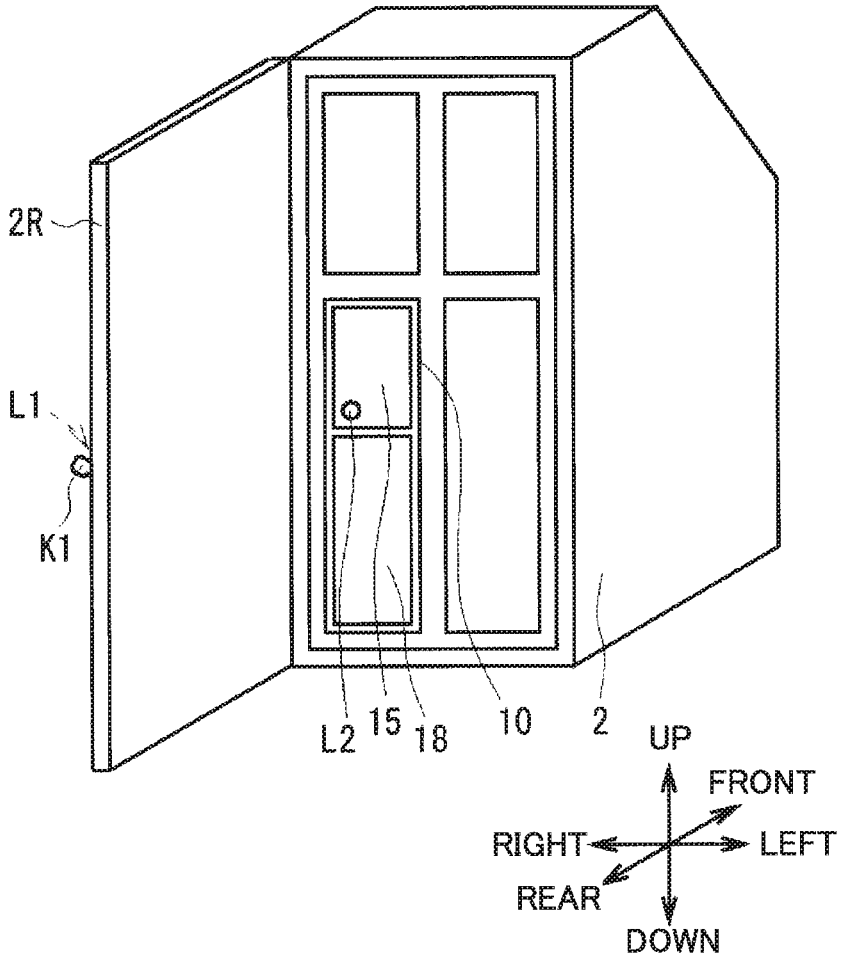
FIG. 2B is a schematic view illustrating opening and closing of a rear door of an ATM.

As illustrated in FIG. 2A and FIG. 2B, the casing 2 of the ATM 1 has a large opening at a rear face, and openable and closeable rear door 2R is provided so as to open up and close off the opening. The rear door 2R includes a first lock L1, and is locked and unlocked by a corresponding first key K1.

Namely, when the first lock L1 is locked in a closed state of the rear door 2R, the closed state the rear door 2R illustrated in FIG. 2A is maintained, enabling access to the interior to be restricted. When the first lock L1 of the casing 2 is unlocked using the first key K1, the rear door 2R can be opened as illustrated in FIG. 2B, thereby enabling access to the interior to be permitted.

1-2. Banknote Deposit/Withdrawal Device Configuration

Figure 3:
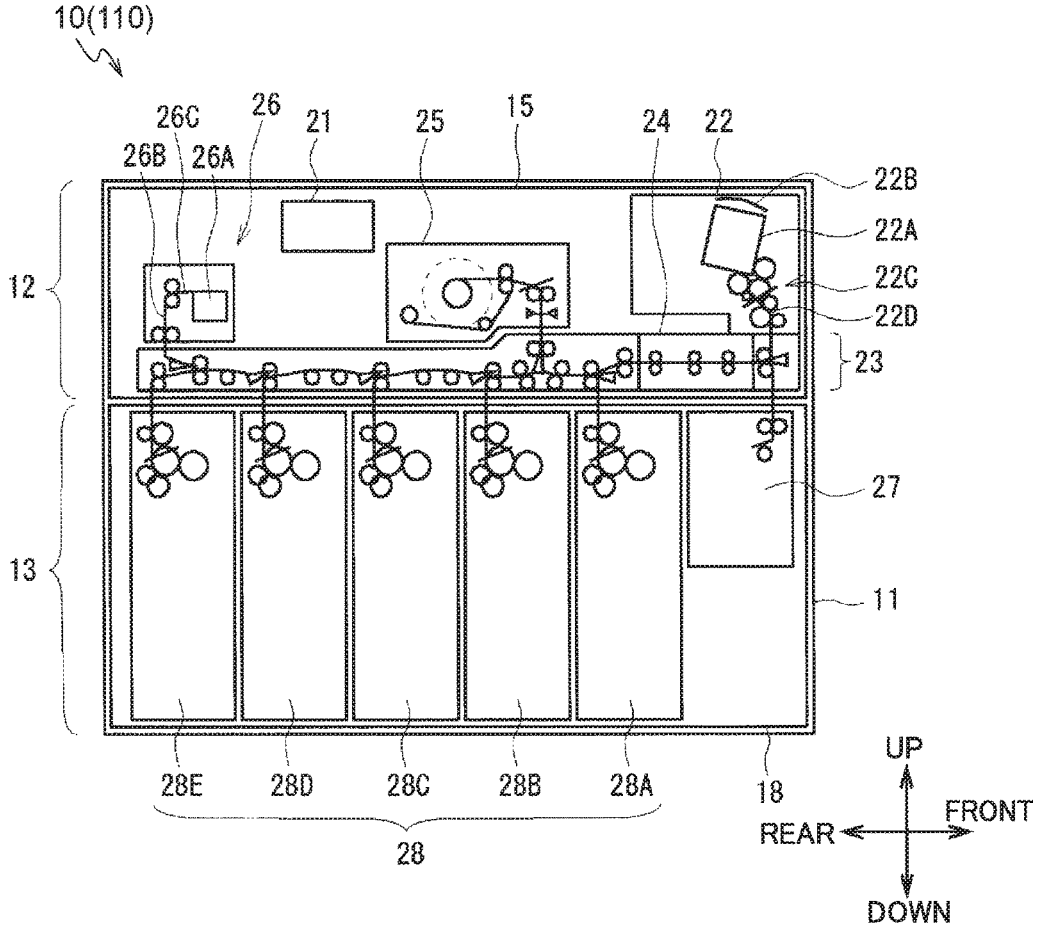
FIG. 3 is a schematic view illustrating configuration of a banknote deposit/withdrawal device according to a first exemplary embodiment.

As illustrated in side view in FIG. 3, the banknote deposit/withdrawal device 10 is incorporated with plural sections for performing various processing relating to banknotes inside a banknote deposit/withdrawal device casing 11 that forms an outer periphery of the banknote deposit/withdrawal device 10. The banknote deposit/withdrawal device 10 is configured broadly split into an upper section block 12 that takes up a portion to the upper side of the approximate center in an up-down direction, and a lower section block 13 that closes up a portion on the lower side of the approximate center in an up-down direction.

The upper section block 12 is configured with an upper section unit 15, that serves as a movable unit, in its center. The upper section unit 15 is formed in a rectangular block shape with its length in a front-rear direction, and as illustrated in FIG. 4, is attached to the banknote deposit/withdrawal device casing 11 through slide rails 16 capable of sliding along the front-rear direction.

Figure 4A:
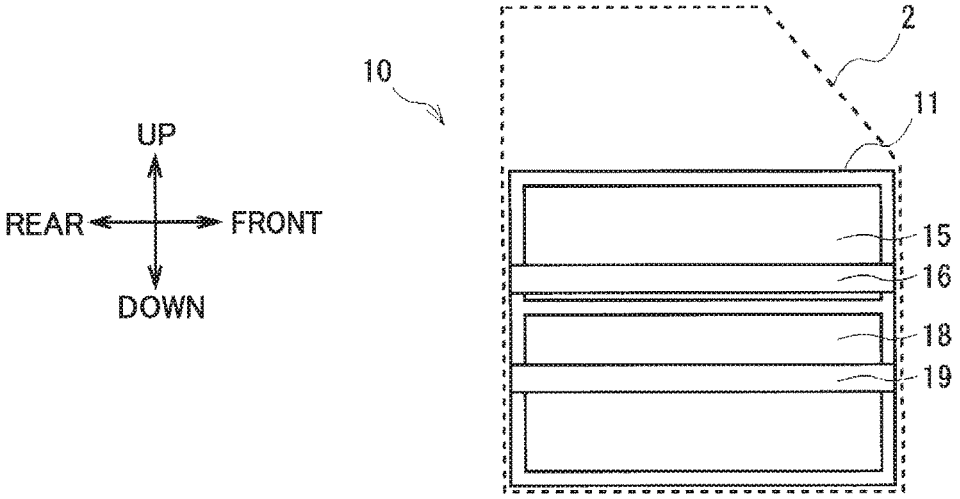
FIG. 4A is a schematic view illustrating pulling out of respective blocks of a banknote deposit/withdrawal device.
Figure 4B:
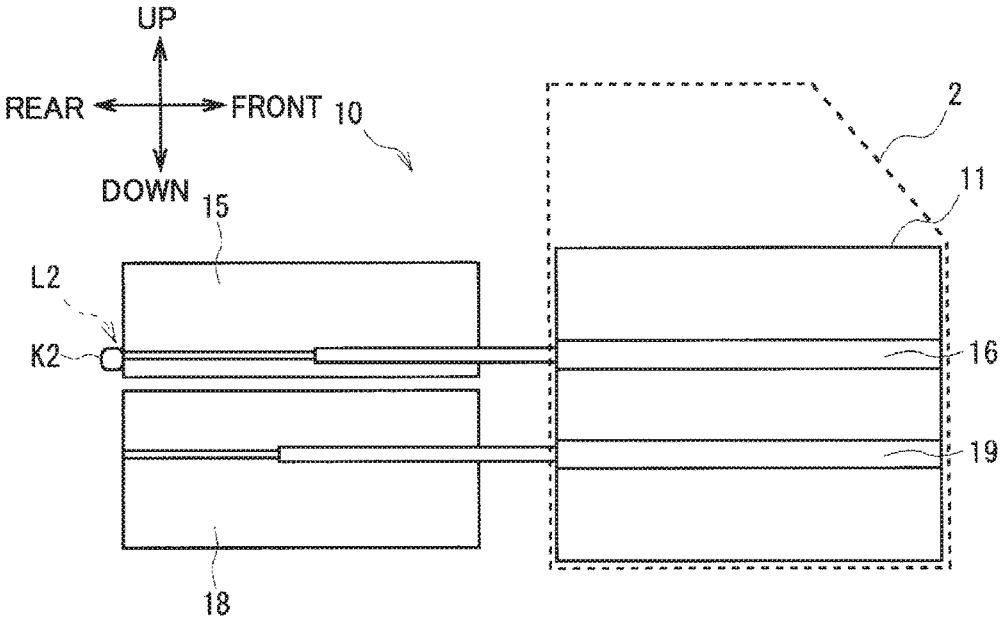
FIG. 4B is a schematic view illustrating pulling out of respective blocks of a banknote deposit/withdrawal device.

Thus, the upper section unit 15 is stowed inside the banknote deposit/withdrawal device casing 11 as illustrated in FIG. 4A, and pulled out toward the rear of the banknote deposit/withdrawal device casing 11 as illustrated in FIG. 4B, by moving (sliding) the upper section unit 15 along the front-rear direction with respect to the banknote deposit/withdrawal device casing 11 in the open state of the rear door 2R of the casing 2 (FIG. 2B).

As illustrated in FIG. 2B, a second lock L2 is provided at a rear face of the upper section unit 15, and is locked and unlocked using a second key K2 (FIG. 4B). In the banknote deposit/withdrawal device 10, in a stowed state of the upper section unit 15 inside the banknote deposit/withdrawal device casing 11 (FIG. 4A), locking the second lock L2 enables pulling out of the upper section unit 15 from inside the banknote deposit/withdrawal device casing 11 to be suppressed. In the banknote deposit/withdrawal device 10, it is possible to permit the upper section unit 15 to be pulled out from inside the banknote deposit/withdrawal device casing 11, as illustrated in FIG. 4B, by unlocking the second lock L2 using the second key K2.

The lower section block 13 (FIG. 3) is configured with a lower section frame 18 aligned with the upper section unit 15, in its center. As illustrated in FIG. 4A, the lower section frame 18 is formed in a rectangular block shape with its length in the front-rear direction, similarly to the upper section unit 15, and is attached to the banknote deposit/withdrawal device casing 11 through slide rails 19 that are capable of sliding along the front-rear direction. The lower section frame 18 is not attached with a second lock L2 such as the upper section unit 15.

Accordingly, in the open state of the rear door 2R of the casing 2 (FIG. 2B), the lower section frame 18 moves (slides) along the front-rear direction with respect to the banknote deposit/withdrawal device casing 11 without employing the second key K2, so as to stow the lower section frame 18 inside the banknote deposit/withdrawal device casing 11 as illustrated in FIG. 4A, or so as to pull out the lower section frame 18 toward the rear of the banknote deposit/withdrawal device casing 11 as illustrated in FIG. 4B.

Note that, in the financial institution installed with the ATM 1, staff, maintenance technicians, and the like are, for example, set with individual security clearance levels according to their job role. For example, a member of staff with a low level security clearance possesses the first key K1, but does not possess the second key K2. A member of staff with a high level security clearance possesses both the first key K1 and the second key K2.

Accordingly, a member of staff with a low level security clearance may open the rear door 2R and pull out the lower section frame 18 of the banknote deposit/withdrawal device 10, but may not pull out the upper section unit 15. On the other hand, a member of staff with a high level security clearance may pull out the upper section unit 15 in addition to the lower section frame 18.

1-2-1. Upper Section Block Configuration

A banknote controller 21, a deposit/withdrawal section 22, a conveyance section 23, a verification section 24, a temporary holding section 25, and an upper section storage box 26 are provided inside the upper section unit 15 of the upper section block 12 (FIG. 3). The banknote controller 21 performs overall general control. The deposit/withdrawal section 22 exchanges banknotes with the customer. The conveyance section 23 conveys banknotes to the respective sections. The verification section 24 verifies banknotes. The temporary holding section 25 temporarily stores banknotes. The upper section storage box 26 stores reject banknotes that have been determined to be unsuitable for re-use.

The banknote controller 21, serving as a controller, is configured around a CPU (not illustrated in the drawings), similarly to the main controller 9. The banknote controller 21 reads and executes specific programs from ROM (not illustrated in the drawings), flash memory, or the like, to perform various processing, such as processing to decide the conveyance destinations of banknotes, and processing to control operation of the various sections. The banknote controller 21 includes an internal storage section configured by RAM, flash memory, or the like. The storage section is stored with various information.

The deposit/withdrawal section 22, serving as an input/output section, is positioned at an upper front portion inside the upper section block 12. The deposit/withdrawal section 22 includes an internal receptacle 22A that houses banknotes inserted by a customer, and banknotes to be withdrawn to the customer. The receptacle 22A is configured capable of being opened and closed from above by a shutter 22B. Plural banknotes are housed in a collected state inside the receptacle 22A, with their sheets faces facing along the front-rear direction, namely in a state lined up along the front-rear direction.

A take-in/discharge port 22C and a deposit/withdrawal conveyance section 22D are provided at the lower front of the deposit/withdrawal section 22. Under the control of the banknote controller 21, the take-in/discharge port 22C switches operation between two operation modes, namely a take-in mode and a discharge mode. Namely, in the take-in mode, the take-in/discharge port 22C separates banknotes inside the receptacle 22A one note at a time to be sent out downward every specific time interval, and passes the banknotes to the conveyance section 23 using the deposit/withdrawal conveyance section 22D.

Sensors of plural types are incorporated inside the verification section 24 in order to verify the denomination, authenticity, condition (whether or not damage is present), and conveyance state of conveyed banknotes. Verification results are sent to the banknote controller 21. Note that conveyance states indicate states such as, for example, whether or not a banknote is at an angle with respect to a conveyance direction, whether or not there is an appropriate spacing between conveyed banknotes, and whether or not plural banknotes are overlapping each other (namely, whether or not overlapping conveyance or strings of touching banknotes have occurred).

Specifically, as illustrated in some of the drawings, a conveyance path linking between a front exchange port 24F on the front side and a rear exchange port 24R on the rear side of the verification section 24 is formed by plural rollers, guides, or the like inside the verification section 24. Various sensors employed in banknote verification, such as a transportation sensor that monitors the banknote conveyance state, an image sensor that acquires images of the banknotes, and an authenticity sensor that determines authenticity by detecting magnetic characteristics of the banknotes, are disposed inside the verification section 24.

The temporary holding section 25 employs what is referred to as a tape escrow method, and stores banknotes by wrapping the banknotes against a circumferential side face of a circular cylinder shaped drum together with a tape, and feeds out the banknotes by peeling the tape away from the circumferential side face. Due to the structure of the temporary holding section 25, when feeding out stored banknotes, the banknotes are fed out in the reverse sequence to the sequence in which they were stored, with, for example, the spacings between the respective banknotes, and the angle of each banknote with respect to the direction of progress, maintained. In other words, the temporary holding section 25 stores and feeds out banknotes with the conveyance state of the banknotes preserved.

The upper section storage box 26, serving as a segregation storage box, is provided inside the upper section block 12 in the vicinity of a rear end, at a position adjacent to and directly above the conveyance section 23. The upper section storage box 26 includes a storage space 26A in which banknotes are internally stored, a conveyance section 26B that conveys banknotes passed from the conveyance section 23 on the lower side upward, and a discharge mechanism 26C that discharges banknotes and stacks the banknotes in the storage space 26A. The upper section storage box 26 internally stores banknotes that have been determined to be counterfeit (also referred to below as counterfeit notes) by the verification section 24 and the banknote controller 21, described later, and have been conveyed by the conveyance section 23. Namely, the upper section storage box 26 functions as what is referred to as a counterfeit note box, or a counterfeit note storage box.

1-2-2. Conveyance Section Configuration

The conveyance section 23 is positioned so as to run across a lower end portion within the upper section block 12, namely substantially at the up-down center of the overall banknote deposit/withdrawal device 10, along the front-rear direction. Overall, the conveyance section 23 has a narrow elongated shape running along the front-rear direction, and is thin in the up-down direction. Several rotating rollers, guides that guide the banknotes, and the like, are disposed as appropriate inside the conveyance section 23, thereby forming a linear conveyance path that conveys banknotes mainly along the front-rear direction, with a short edge direction of the banknotes as the direction of progress.

Figure 5:
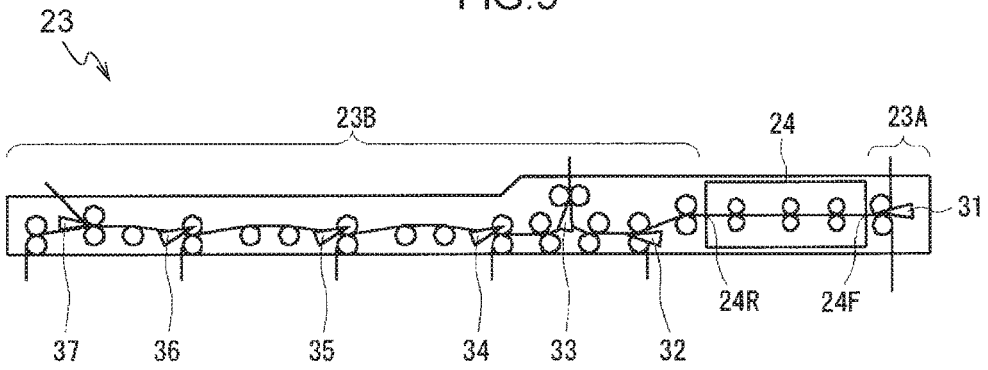
FIG. 5 a schematic view illustrating configuration of a conveyance section.

As illustrated in enlarged view in FIG. 5, the conveyance section 23 is configured by a front conveyance section 23A and a rear conveyance section 23B. The front conveyance section 23A serves as a first conveyance section and is positioned at the front side of the verification section 24. The rear conveyance section 23B serves as a second conveyance section and is positioned at the rear side of the verification section 24.

Plural switching sections 31, 32, 33, 34, 35, 36, and 37 are disposed in the conveyance section 23. The switching sections 31 to 37 are each configured by a member referred to as a blade (represented by triangular shapes in the drawings) and plural rollers disposed around the blade. The blades are long in the left-right direction, and are formed in wedge shapes as viewed along the left-right direction. The blades rotate to change their inclination direction, thereby switching the banknote conveyance directions two ways or three ways. The respective rollers are disposed facing each other across the banknote conveyance path.

In the conveyance section 23, the switching section 31, the verification section 24, and the switching sections 32 to 37 are respectively connected together by short conveyance paths that are comparatively short, so as to form a linear conveyance path running along the front-rear direction overall. The switching sections 31 to 37 also form respective short conveyance paths between the respective sections within the upper section block 12 (FIG. 3) and the respective sections within the lower section block 13. Each of the short conveyance paths is configured by a guide (not illustrated in the drawings) that guides banknotes, rollers (only some of which are illustrated) that advance the banknotes along by being rotation driven in a state contacting the banknotes, and the like.

In this configuration, the conveyance section 23 switches the switching sections 31 to 37 as appropriate under the control of the banknote controller 21, enabling banknotes to be conveyed to the respective sections inside the banknote deposit/withdrawal device 10. The switching section 37 disposed furthest to the rear side inside the rear conveyance section 23B switches the conveyance direction of banknotes conveyed from the front to either a banknote storage box 28E (FIG. 3) positioned furthest to the rear side inside the lower section block 13, or to the upper section storage box 26 (FIG. 3).

In this manner, the conveyance section 23 forms a linear conveyance path running internally along the front-rear direction. The conveyance section 23 conveys banknotes primarily in the front-rear direction along the conveyance path, and switches the conveyance path using the plural switching sections.

1-2-3. Lower Section Block Configuration

In the lower section block 13, six slots are formed in a row along the front-rear direction in the lower section frame 18 described above (FIG. 3, FIG. 4A, FIG. 4B). A reject box 27 is loaded into the slot furthest to the front side. Banknote storage boxes 28A, 28B, 28C, 28D, and 28E (referred to collectively as the banknote storage boxes 28 below) are respectively provided in the other five slots.

In the banknote deposit/withdrawal device 10, configuration is made such that, in a state in which the lower section frame 18 has been pulled out to the rear of the banknote deposit/withdrawal device casing 11 (FIG. 4B), the reject box 27 and each of the banknote storage boxes 28 can be pulled out upward from the respective slots, and can be loaded into the respective slots by lowering downward from above. Namely, the reject box 27 and the respective banknote storage boxes 28 can easily be fitted into and removed from the lower section frame 18.

The reject box 27 is positioned furthest toward the front side, and also toward the upper side, inside the lower section block 13, is formed in a rectangular block shape with its length in the up-down direction, and contains an internal space for stacking and storing banknotes. The reject box 27 internally stores banknotes that have been determined to have a heavy damage and to be unsuitable for re-use (namely, reject banknotes) by the verification section 24 and the banknote controller 21, and that have been conveyed by the conveyance section 23.

Each of the banknote storage boxes 28 is formed in a rectangular block shape with its length in the up-down direction, and contain an internal space for stacking and storing banknotes. Note that the banknote storage boxes 28 have an up-down direction length substantially equal to that of the lower section block 13.

Each of the banknote storage boxes 28 is pre-set with a denomination of banknotes to be stored. The banknote storage boxes 28 internally stack and store banknotes that have been determined to have a light degree of damage and to be suitable for re-use by the verification section 24 and the banknote controller 21, and that have been conveyed by the conveyance section 23 according to their denomination. On receipt of an instruction to feed out banknotes from the banknote controller 21, the banknote storage boxes 28 separate and feed out the stacked banknotes one note at a time, and pass the banknotes to the conveyance section 23.

Note that the banknote storage boxes 28 are also capable of operating as withdrawal boxes that only feed out stored banknotes, or operating as deposit boxes that only store conveyed banknotes, depending on the control of the banknote controller 21.

When the banknote storage boxes 28 are removed from the slots in the lower section frame 18, the internally stored banknotes are taken out, or banknotes are stored, by a member of staff of the financial institution or the like. When this is performed, the banknotes that are stored have been verified by denomination, authenticity, degree of damage, and the like using a specific banknote processing device or the like, and are good condition banknotes that can be withdrawn to a customer during withdrawal processing.

1-3. Deposit Processing and Withdrawal Processing

Figure 6:
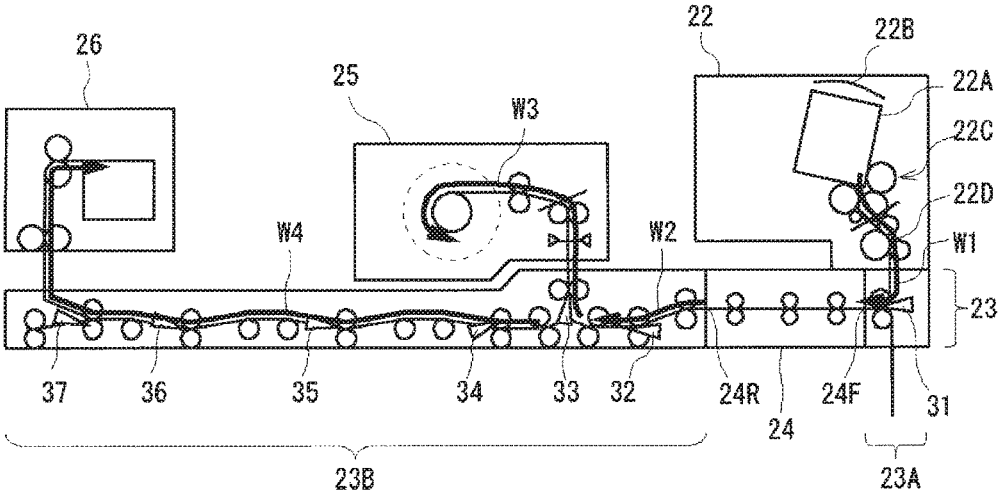
FIG. 6 is a schematic view illustrating banknote conveyance during deposit counting processing.
Figure 7:
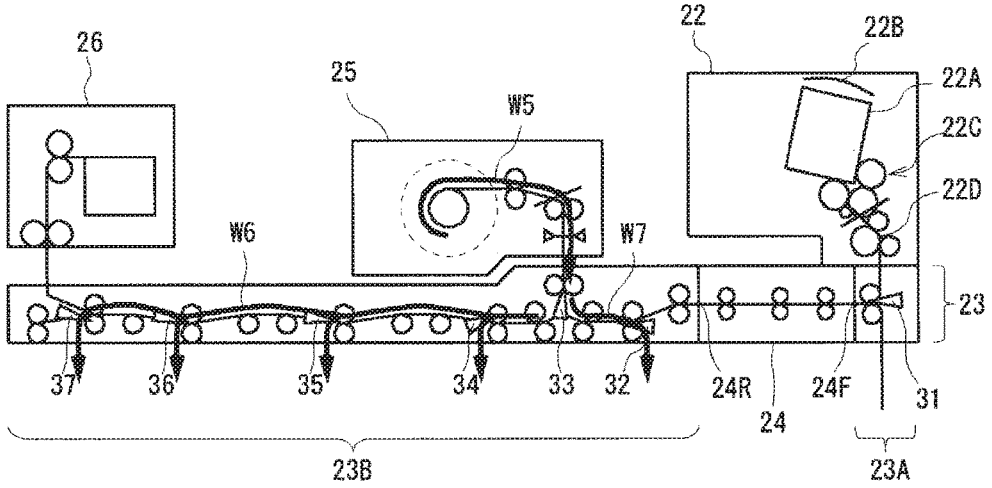
FIG. 7 is a schematic view illustrating banknote conveyance during deposit storage processing.
Figure 8:
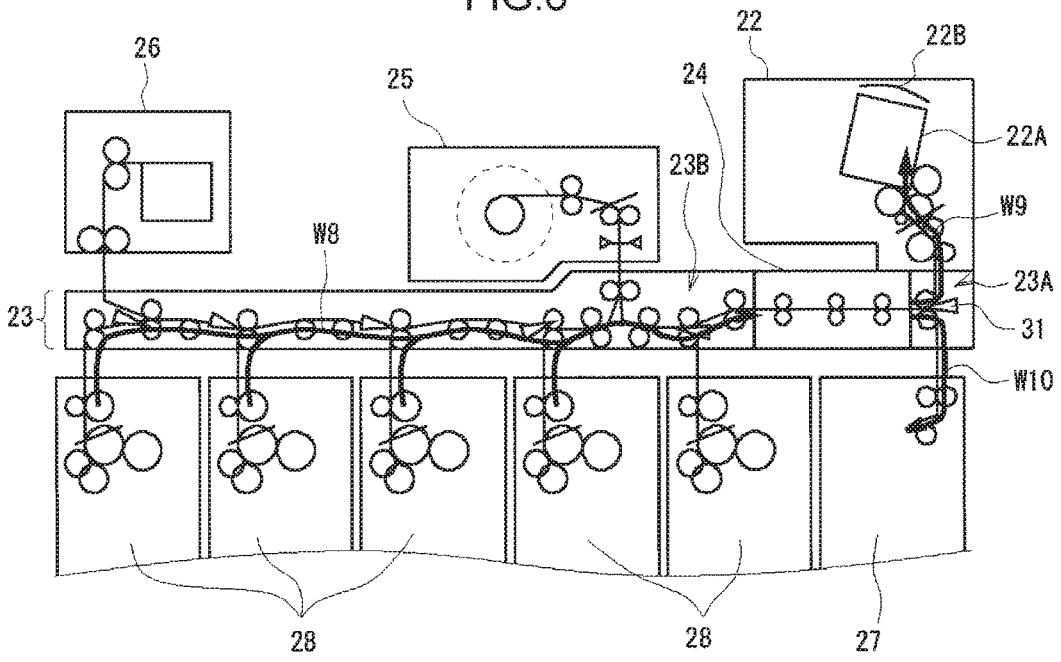
FIG. 8 is a schematic view illustrating banknote conveyance during withdrawal processing.

Next, detailed explanation follows regarding deposit processing and withdrawal processing of banknotes in the banknote deposit/withdrawal device 10 respectively, with reference to FIG. 6, FIG. 7, and FIG. 8. Note that, both FIG. 6 and FIG. 7 show enlarged views of the deposit/withdrawal section 22, the conveyance section 23, the verification section 24, the temporary holding section 25, and the upper section storage box 26 of the upper section block 12 of the banknote deposit/withdrawal device 10.

1-3-1. Deposit Processing

First, explanation follows regarding deposit processing when a customer (user) deposited in banknotes to the ATM 1, with reference to FIG. 5 and FIG. 6. In deposit processing, under the control of the banknote controller 21, the banknote deposit/withdrawal device 10 is configured to first perform deposit counting processing to count the number of inserted banknotes while classifying the banknotes by denomination and the like, before performing deposit storage processing to convey the banknotes to an appropriate storage location to be stored.

Specifically, for example, the banknote controller 21 receives an operation to start deposit processing that is input by a customer using the operation and display section 6 (FIG. 1), and then starts the deposit counting processing, and opens the shutter 22B of the deposit/withdrawal section 22 to allow banknotes to be inserted into the receptacle 22A. Next, the banknote controller 21 receives input of an operation through the operation and display section 6 to start taking in the banknotes, and closes the shutter 22B and operates the take-in/discharge port 22C in the take-in mode, thereby separating and taking in the banknotes into the receptacle 22A one note at a time, and passing the banknotes in sequence to the front conveyance section 23A of the conveyance section 23 positioned downstream.

The front conveyance section 23A switches the switching section 23 to form a conveyance path linking the deposit/withdrawal section 22 and the verification section 24 on the rear side, and, as illustrated by the arrow W1 (FIG. 6), the banknotes are passed downstream in sequence to the front exchange port 24F on the front side of the verification section 24.

The verification section 24 verifies each of the banknotes in sequence as the banknotes are conveyed toward the rear through the inside of the verification section 24. The verification section 24 passes the banknotes to the rear conveyance section 23B through the rear exchange port 24R on the rear side, and sends the banknote verification results to the banknote controller 21.

The banknote controller 21 first determines the degree of damage, denomination, or authenticity of each banknote based on the acquired verification results. Next, the banknote controller 21 decides the final conveyance destination of each banknote. Specifically, for example, the banknote controller 21 decides that banknotes of types that cannot be handled, such as foreign banknotes (referred to below as deposit reject banknotes), are ultimately to be returned to the customer through the deposit/withdrawal section 22, with a temporary safekeeping location within the conveyance path of the rear conveyance section 23B of the conveyance section 23.

The banknote controller 21 respectively decides on the upper section storage box 26 as the final conveyance destination for banknotes determined to be counterfeit (counterfeit notes), the reject box 27 as the final conveyance destination for banknotes that are genuine but have a heavy damage (referred to below as reject banknotes), and the banknote storage boxes 28 of the respective denominations as the final conveyance destinations for genuine banknotes (referred to below as deposit acceptable banknotes). Moreover, the banknote controller 21 associates the denomination, serial number, the decided conveyance destination, and the like of each banknote with the banknote conveyance sequence, and stores this in the storage section as information during counting by the verification section 24.

Next, under the control of the banknote controller 21, the conveyance section 23 switches the conveyance paths of the respective switching sections as appropriate according to the decided conveyance destinations, and conveys the banknotes. Specifically, the conveyance section 23 conveys the banknotes to the switching section 33 as shown by the arrow W2. Then, for banknotes with a final conveyance destination of the respective banknote storage boxes 28, the conveyance section 23 moves the banknotes upward using the switching section 33, as shown by the arrow W3, and conveys the banknotes to the temporary holding section 25 to be stored.

For banknotes with a final conveyance destination of the deposit/withdrawal section 22 (namely deposit reject banknotes), the conveyance section 23 moves the banknotes toward the rear using the switching section 33, and retains the banknote within the conveyance path of the rear conveyance section 23B.

For banknotes with a final conveyance destination of the upper section storage box 26 (namely counterfeit notes), as shown by the arrow W4, in cases in which there are no deposit reject banknotes retained in the rear conveyance section 23B the conveyance section 23 moves the banknote toward the rear using the switching section 33, moves the banknote toward the rear using the switching sections 34, 35, and 36 in sequence, then moves the banknote upward using the switching section 37 and conveys the banknote to the upper section storage box 26 to be stored. In cases in which there are deposit reject banknotes retained in the rear conveyance section 23B, the conveyance section 23 cannot convey the counterfeit note to the upper section storage box 26, and so the deposit reject banknotes are conveyed to the temporary holding section 25 and stored together with the deposit acceptable banknotes.

Finally, when all of the banknotes have been taken in from the receptacle 22A of the deposit/withdrawal section 22, in cases in which deposit reject banknotes are retained in the rear conveyance section 23B, the banknote controller 21 conveys the deposit reject banknotes to the deposit/withdrawal section 22 to be returned to the customer, and ends the deposit counting processing. When this is performed, the banknote controller 21 calculates a deposit amount based on a summed result of the denominations and number of the banknotes taken in from the deposit/withdrawal section 22, and displays a specific operation instruction screen on the operation and display section 6 to present the deposit amount to the customer and allow the customer to select whether or not to continue with the deposit processing.

If the customer instructs the banknote controller 21 to continue with the deposit processing, the banknote controller 21 starts deposit storage processing, as illustrated in FIG. 7. Specifically, the banknote controller 21 first starts feed-out processing in the temporary holding section 25, thereby feeding out the stored banknotes (deposit acceptable banknotes) in sequence to be passed to the switching section 33 of the conveyance section 23 positioned downstream, as shown by the arrow W5.

The banknote controller 21 moreover controls the respective switching sections of the rear conveyance section 23B as appropriate, according to the conveyance destination of each banknote, so as to convey each banknote to its respective final conveyance destinations. Specifically, the banknote controller 21: conveys each banknote of deposit acceptable banknotes to the respective banknote storage boxes 28, as shown by the arrows W6 and W7; conveys reject banknotes to the reject box 27 using the verification section 24 and the front conveyance section 23A; and conveys counterfeit notes to the upper section storage box 26 using the rear conveyance section 23B. The respective banknotes are then stored.

However, if the customer instructs the banknote controller 21 to halt the deposit processing, out of the banknotes retained in the temporary holding section 25, the banknote controller 21 conveys deposit acceptable banknotes in sequence toward the front using the rear conveyance section 23B, the verification section 24 and the front conveyance section 23A, replaces the banknotes in the receptacle 22A of the deposit/withdrawal section 22, and releases the shutter 22B to return the banknotes to the customer. When this is performed, any counterfeit notes held in the temporary holding section 25 are conveyed to the upper section storage box 26 using the rear conveyance section 23B of the conveyance section 23 and stored, similarly to when continuing with deposit processing.

In this manner, in the banknote deposit/withdrawal device 10, if deposit reject banknotes are not being retained in the rear conveyance section 23B, banknotes determined to be counterfeit notes based on the verification results of the verification section 24 during deposit processing are conveyed to the upper section storage box 26 through the rear conveyance section 23B without being conveyed to the temporary holding section 25.

1-3-2. Withdrawal Processing

Next, explanation follows regarding withdrawal processing performed when a customer withdraws banknotes from the ATM 1, with reference to FIG. 8. In withdrawal processing, under the control of the banknote controller 21, the banknote deposit/withdrawal device 10 performs withdrawal processing to withdrawal banknotes in numbers and denominations corresponding to an instructed amount.

Specifically, first the banknote controller 21 receives input of a specific operation, including a withdrawal amount, from the customer using the operation and display section 6 (FIG. 1), and decides the numbers and denominations of banknotes to correspond to the withdrawal amount. The banknote controller 21 then separates and feeds out banknotes stored in a stacked state inside the respective banknote storage boxes 28 one note at a time according to the decided numbers and denominations, and passes the banknotes in sequence to the rear conveyance section 23B.

Next, the banknote controller 21 conveys the respective banknotes in sequence from the rear conveyance section 23B to the verification section 24, and verifies the banknotes as they are moved toward the front through the verification section 24, and then moves the banknotes into the front conveyance section 23A.

When this is performed, according to a transportation state of each banknote, the banknote controller 21 decides whether the conveyance destination will be the deposit/withdrawal section 22 or the reject box 27. Specifically, if there is nothing wrong with the transportation state of the banknote, the banknote controller 21 forms a conveyance path linking between the deposit/withdrawal section 22 at the upper side and the verification section 24 at the rear side at the switching section 31 of the front conveyance section 23A, and as shown by the arrow W9, conveys the banknote downstream to the deposit/withdrawal section 22 to be discharged into the receptacle 22A.

If there is an issue with the transportation state of the banknote, for example overlapping conveyance, the banknote controller 21 forms a conveyance path linking the verification section 24 at the rear side to the reject box 27 at the lower side at the switching section 31 of the front conveyance section 23A, and as shown by the arrow W10, conveys the banknote downstream to the reject box 27 to be stored.

Finally, when the banknote controller 21 has finished discharging all of the banknotes making up the withdrawal amount into the receptacle 22A of the deposit/withdrawal section 22, the banknote controller 21 opens the shutter 22B to allow the customer to take out the banknotes.

In this manner, during withdrawal processing, the banknote deposit/withdrawal device 10 conveys banknotes corresponding to the withdrawal amount from the respective upstream banknote storage boxes 28 to the downstream deposit/withdrawal section 22 to be passed to the customer, while switching the switching section 31 of the front conveyance section 23A based on the transportation state of the banknotes.

1-4. Operation and Effects

In the configuration described above, the banknote deposit/withdrawal device 10 according to the first exemplary embodiment is provided with the conveyance section 23 that forms a linear conveyance path along the front-rear direction inside the upper section block 12, in the vicinity of a boundary with the lower section block 13. The verification section 24 is disposed between the front conveyance section 23A and the rear conveyance section 23B.

The banknote deposit/withdrawal device 10 enables the length of the conveyance section 23 to be kept very short, such that the transportation distance is shorter than in cases in which rather long conveyance paths are respectively formed at an upper side and a lower side of the casing, as hitherto. The banknote deposit/withdrawal device 10 is accordingly capable of greatly reducing the risk of faults related to banknote conveyance in the conveyance section 23, such as jams, occurring, and thereby enables stable transportation.

In the banknote deposit/withdrawal device 10, the upper section storage box 26 is disposed in the vicinity of the rear end of the upper section block 12, namely in the vicinity of a terminal end at the rear side of the rear conveyance section 23B. Moreover, the rear conveyance section 23B conveys banknotes to the upper section storage box 26 using the switching section 37, this being the furthest switching device from the verification section 24 on the internal conveyance path of the rear conveyance section 23B.

Accordingly, during deposit processing, in the banknote deposit/withdrawal device 10, banknotes determined as counterfeit notes based on the verification results of the verification section 24 may be conveyed directly to the upper section storage box 26 and stored using the rear conveyance section 23B, without being stored in the temporary holding section 25.

Note that in the banknote deposit/withdrawal device 10, banknotes determined to be counterfeit notes may, for example, be conveyed to the temporary holding section 25 and stored regardless of whether or not deposit reject banknotes are present in the rear conveyance section 23B. In such cases, the banknotes determined as counterfeit notes may be conveyed from the temporary holding section 25 to the upper section storage box 26 and stored during the later stage deposit storage processing.

Note that, in a case in which the upper section storage box 26 is omitted from the banknote deposit/withdrawal device 10, genuine banknotes, counterfeit notes are either stored in the reject box 27, or conveyed to the deposit/withdrawal section 22 and are returned to the customer, from the perspective of segregating counterfeit notes from other.

In cases in which the counterfeit notes are stored in the reject box 27, reject banknotes and counterfeit notes are both present inside the reject box 27, necessitating the complex task of sorting the notes later on. Moreover, in cases in which the counterfeit notes are returned to the customer, the circulation of counterfeit notes cannot be prevented.

Regarding this point, in the banknote deposit/withdrawal device 10, the upper section storage box 26 is connected to the rear conveyance section 23B, and counterfeit notes are stored in the upper section storage box 26. Accordingly, counterfeit notes and reject banknotes can be stored in a segregated state, rendering a sorting task unnecessary. Since the banknote deposit/withdrawal device 10 does not return counterfeit notes to the customer, the further circulation of counterfeit notes may be prevented.

From another perspective, in the banknote deposit/withdrawal device 10, both the temporary holding section 25 and the upper section storage box 26 are connected to the rear conveyance section 23B. Accordingly, in the banknote deposit/withdrawal device 10, after banknotes have been verified by the verification section 24, the conveyance destination of the banknotes passed from the rear exchange port 24R to the rear conveyance section 23B may be easily switched to either the temporary holding section 25 or the upper section storage box 26 simply by switching the switching section 33 (FIG. 6).

From yet another perspective, in the banknote deposit/withdrawal device 10, the upper section storage box 26 is connected to the conveyance path of the rear conveyance section 23B further than the temporary holding section 25 from the verification section 24. Accordingly, the banknote deposit/withdrawal device 10 enables deposit acceptable banknotes, that make up the majority of deposited banknotes, to be conveyed to the temporary holding section 25 along a comparatively short conveyance path, and stored, while counterfeit notes that are only infrequently detected are conveyed to the upper section storage box 26 along a comparatively long conveyance path, and stored. Namely, the banknote deposit/withdrawal device 10 may reduce the average conveyance path length, and thereby may reduce the likelihood of banknote jams and the like from occurring.

Due to the above configuration, in the banknote deposit/withdrawal device 10 according to the first exemplary embodiment, the conveyance section 23 that forms the linear conveyance path along the front-rear direction is provided inside the upper section block 12 in the vicinity of the boundary with the lower section block 13, and the upper section storage box 26 is disposed in the vicinity of the rear side terminal end of the rear conveyance section 23B. Counterfeit notes are conveyed to the upper section storage box 26 using the switching section 37. Due to keeping the conveyance path length short, the banknote deposit/withdrawal device 10 may reduce the frequency with which faults such as banknote jams occur, and the banknote deposit/withdrawal device 10 is also may prevent the circulation of counterfeit notes by storing counterfeit notes segregated from genuine banknotes, reject banknotes, and the like.

2. Second Exemplary Embodiment

In a second exemplary embodiment, although the usage of the upper section storage box 26 and the accompanying banknote conveyance processing differ from in the first exemplary embodiment, each section is configured similarly to in the first exemplary embodiment. In the second exemplary embodiment, deposit reject banknotes are stored in the upper section storage box 26.

Namely, the discharge mechanism 26C (FIG. 3) of the upper section storage box 26 has a separating function to separate and feed out banknotes stored inside the storage space 26A one note at a time, in addition to a function to discharge banknotes and stack the banknotes in the storage space 26A. Accordingly, the upper section storage box 26 is capable of storing banknotes conveyed by the rear conveyance section 23B inside the storage space 26A, and capable of feeding out banknotes stored in the storage space 26A one note at a time to be passed to the rear conveyance section 23B.

During deposit processing, the banknote controller 21 performs control that differs from that of the first exemplary embodiment. Specifically, during deposit counting processing, first the banknote controller 21 decides the upper section storage box 26 as a temporary safekeeping location for the deposit reject banknotes that are to be returned to the customer through the deposit/withdrawal section 22. The banknote controller 21 also decides the reject box 27 as the final conveyance destination for counterfeit notes, similarly to reject banknotes.

The conveyance section 23 then conveys banknotes with a final conveyance destination of the banknote storage boxes 28 or the reject box 27 (namely, deposit acceptable banknotes, reject banknotes, and counterfeit notes) to the temporary holding section 25 to be stored. The conveyance section 23 also conveys banknotes with a final conveyance destination of the deposit/withdrawal section 22 (namely, deposit reject banknotes) through the rear conveyance section 23B to the upper section storage box 26 to be stored.

Finally, when the banknote controller 21 has finished taking in all of the banknotes from the receptacle 22A of the deposit/withdrawal section 22, all of the deposit reject banknotes stored in the upper section storage box 26 are fed out and conveyed to the deposit/withdrawal section 22 using the conveyance section 23 and returned to the customer, and the deposit counting processing is then ended.

Then, during the deposit storage processing, the banknote controller 21 conveys each of the deposit acceptable banknotes to the respective banknote storage boxes 28, and conveys reject banknotes and counterfeit notes to the reject box 27 using the verification section 24 and the front conveyance section 23A, to be respectively stored.

In this manner, in the banknote deposit/withdrawal device 10 of the second exemplary embodiment, banknotes determined to be deposit reject banknotes during deposit processing are conveyed to the upper section storage box 26 through the rear conveyance section 23B, without being conveyed to the temporary holding section 25.

Note that, in a case in which the upper section storage box 26 is omitted from the banknote deposit/withdrawal device 10, deposit reject banknotes would be retained on the conveyance path of the rear conveyance section 23B of the conveyance section 23, similarly to the first exemplary embodiment. In such cases, the number of deposit reject banknotes that could be retained would be limited to a comparatively small number, for example four or five notes, depending on the length of the conveyance path in the rear conveyance section 23B.

Accordingly, in cases in which a large number of deposit reject banknotes, at a point in which it becomes impossible to retain all of the deposit reject banknotes in the rear conveyance section 23B, it would be necessary for the banknote deposit/withdrawal device 10 to interrupt the conveyance and verification of new banknotes from the deposit/withdrawal section 22. Then, the banknote deposit/withdrawal device 10 convey the deposit reject banknotes to the deposit/withdrawal section 22 to be returned once to the customer, and recommence the conveyance and verification of fresh banknotes from the deposit/withdrawal section 22. Accordingly, the banknote deposit/withdrawal device 10 would require a long time to complete deposit processing, resulting the customer kept waiting.

In contrast, in the banknote deposit/withdrawal device 10 according to the second exemplary embodiment, since deposit reject banknotes are stored in the upper section storage box 26, even in a case in which a large number of deposit reject banknotes, all of the deposit reject banknotes could be stored in the upper section storage box 26. Namely, the banknote deposit/withdrawal device 10 may completing deposit processing in a short time, since there is no need to interrupt conveyance and verification of new banknotes from the deposit/withdrawal section 22.

In other respects, the banknote deposit/withdrawal device 10 according to the second exemplary embodiment exhibits similar operation and advantageous effects to those of the first exemplary embodiment.

According to the above configuration, in the banknote deposit/withdrawal device 10 according to the second exemplary embodiment, the conveyance section 23 that forms the linear conveyance path along the front-rear direction is provided inside the upper section block 12 in the vicinity of the boundary with the lower section block 13, and the upper section storage box 26 is disposed in the vicinity of the rear side terminal end of the rear conveyance section 23B. Deposit reject banknotes are conveyed to the upper section storage box 26 using the switching section 37. Accordingly, the banknote deposit/withdrawal device 10 may store all deposit reject banknotes in the upper section storage box 26 and complete deposit processing in a short time without interruption, even in a case in which there are a large quantity of deposit reject banknotes, while reducing the frequency of occurrence of faults, such as banknote jams, by keeping the conveyance path length short.

3. Third Exemplary Embodiment

An ATM 101 (FIG. 1) according to a third exemplary embodiment differs from the ATM 1 according to the first exemplary embodiment in the point that it includes a banknote deposit/withdrawal device 110 in place of the banknote deposit/withdrawal device 10, and is configured similarly in other respects. The banknote deposit/withdrawal device 110 (FIG. 3) differs from the banknote deposit/withdrawal device 10 in the point that it includes an upper section block 112 in place of the upper section block 12. However, a banknote deposit/withdrawal device casing 11 and a lower section block 13 are configured similarly to those of the banknote deposit/withdrawal device 10.

Figure 9:
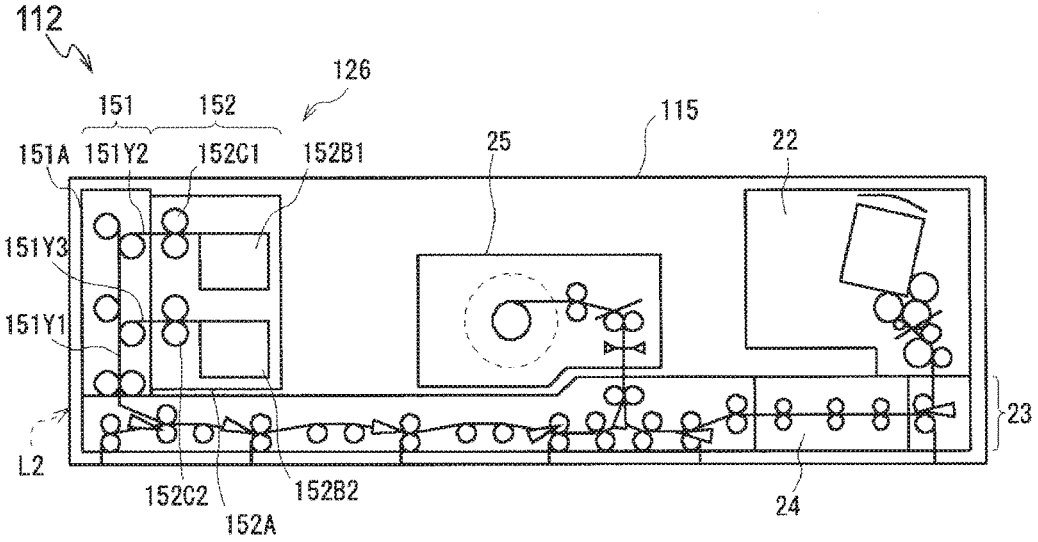
FIG. 9 is a schematic view illustrating configuration of an upper section block according to a second exemplary embodiment.

As illustrated in FIG. 9, the upper section block 112 differs from the upper section block 12 (FIG. 3) according to the first exemplary embodiment in the point that it includes an upper section unit 115 and an upper section storage box 126 in place of the upper section unit 15 and the upper section storage box 26, and is configured similarly in other respects.

The upper section unit 115 is attached to the banknote deposit/withdrawal device casing 11 through the slide rails 16 (FIG. 4A, FIG. 4B) similarly to the upper section unit 15 (FIG. 3, FIG. 4A, and FIG. 4B) according to the first exemplary embodiment. Accordingly, the upper section unit 115 can be pulled out from the banknote deposit/withdrawal device casing 11 toward the rear. A second lock L2 is provided at a rear face of the upper section unit 115, similarly to in the upper section unit 15 (FIG. 2B).

The upper section storage box 126 is configured by a vertical conveyance section 151 on a rear side, and an upper section cassette 152 on a front side. The outer periphery of the vertical conveyance section 151 is covered by a frame 151A formed in a rectangular block shape that is thin and flattened along the front-rear direction. The frame 151A is attached to the upper section unit 115 (FIG. 9) such that a lower end of the frame 151A faces an upper side of the rear end of the conveyance section 23.

In the vertical conveyance section 151, serving as a segregation conveyance section, a conveyance path running mainly in the up-down direction, namely in a vertical direction, is formed by rollers, belts, guides, and the like (only some of which are illustrated) within the frame 151A. Specifically, a vertical conveyance path 151Y1 is formed running along the up-down direction inside the vertical conveyance section 151. Respective horizontal conveyance paths 151Y2 and 151Y3 are formed branching from the vertical conveyance path 151Y1 toward the front, at two locations respectively close to an upper end of, and in the vicinity of the center of, the vertical conveyance section 151.

The outer periphery of the upper section cassette 152 is covered by a frame 152A formed in a rectangular block shape that is longer in the front-rear direction than the vertical conveyance section 151. Two storage spaces 152B1 and 152B2 are disposed superimposed above and below one another inside the frame 152A. Discharge mechanisms 152C1 and 152C2 that discharge banknotes and stack the banknotes in the respective storage spaces 152B1 and 152B2 are provided at a rear side within the frame 152A, at locations respectively connected to the horizontal conveyance paths 151Y2 and 151Y3 of the vertical conveyance section 151. Note that, the discharge mechanisms 152C1 and 152C2 include a separating function in addition to a stacking function, similarly to the discharge mechanism 26C (FIG. 3) according to the second exemplary embodiment.

Namely, the upper section cassette 152 is capable of storing banknotes divided between the two storage spaces 152B1 and 152B2. The upper section cassette 152 is accordingly capable of storing different types of banknote in a segregated state, for example storing reject banknotes in one storage space 152B1, and storing counterfeit notes in the other storage space 152B2.

The frame 152A detachably engages with the frame 151A of the vertical conveyance section 151 through a specific engagement mechanism. Accordingly, when the upper section cassette 152 is applied with force in an upward direction, its engagement with the vertical conveyance section 151 is released, and the upper section cassette 152 is removed from the vertical conveyance section 151, namely from the upper section unit 115. The upper section cassette 152 is engaged with and mounted to the vertical conveyance section 151 by aligning a rear face of the upper section cassette 152 with a front face of the vertical conveyance section 151 and lowering the upper section cassette 152 from above the vertical conveyance section 151.

In this manner, in the upper section storage box 126, the vertical conveyance section 151 on the rear side is attached to the upper section unit 115, and the upper section cassette 152 on the front side is removed from the vertical conveyance section 151 by being lifted in an upward direction.

Note that a rear door 2R of the ATM 101 (FIG. 2A, FIG. 2B) is provided with a first lock L1, similarly to in the first exemplary embodiment. The upper section unit 115 of the banknote deposit/withdrawal device 110 is provided with the second lock L2, as described above.

Accordingly, in the ATM 101, similarly to in the first exemplary embodiment, a member of staff with a high level security clearance and in possession of the second key K2 is able to pull the upper section unit 115 of the banknote deposit/withdrawal device casing 11 out toward the rear. However, a member of staff with a low level security clearance who is not in possession of the second key K2 is not able to pull out the upper section unit 115.

As illustrated in FIG. 9, in the vertical conveyance section 151, a portion of a rear face of the upper section unit 115 further to the upper side than the conveyance section 23 is covered by the frame 151A. Accordingly, in the banknote deposit/withdrawal device 110, even when the rear door 2R has been opened as illustrated in FIG. 2B, access to the respective sections inside the upper section unit 115 from the rear side is prevented as long as the upper section unit 115 is stored inside the banknote deposit/withdrawal device casing 11.

Figure 10:
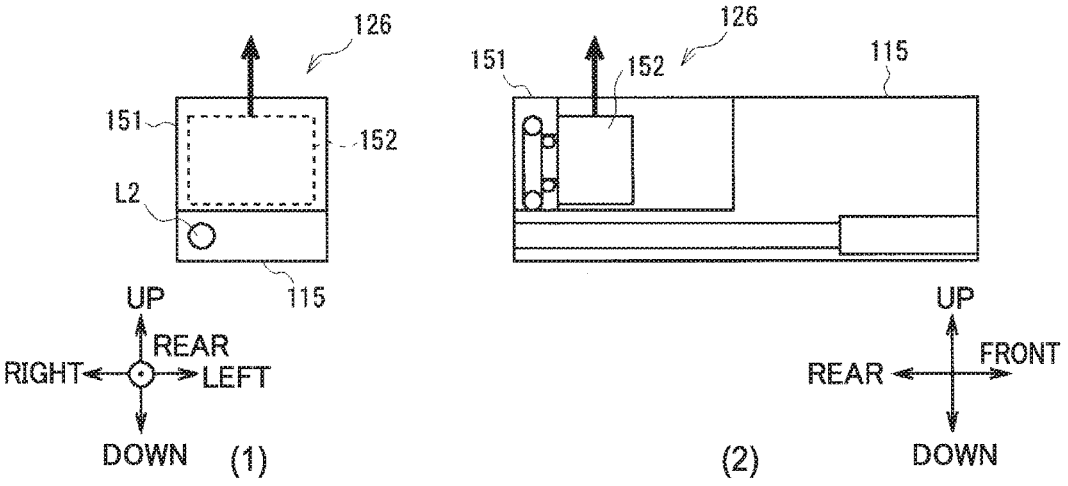
FIG. 10 is a schematic view illustrating removal of an upper section cassette according to the second exemplary embodiment.

Namely, in the banknote deposit/withdrawal device 110, the upper section unit 115 can be pulled out toward the rear as illustrated in FIG. 10 by a member of staff with a high level security clearance, thereby enabling the upper section cassette 152 to be lifted upward and removed from the vertical conveyance section 151. However, in the banknote deposit/withdrawal device 110, a member of staff with a low level security clearance is not permitted to pull the upper section unit 115 out toward the rear, thereby enabling access to the upper section cassette 152 and the like inside the upper section frame, and removal of the upper section cassette 152, to be restricted.

From another perspective, in the banknote deposit/withdrawal device 110, it is desirable for collection operations of counterfeit banknotes to be performed efficiently, with simple removal of the upper section cassette 152 from the vertical conveyance section 151. However, in the banknote deposit/withdrawal device 110, there is also a need to prevent members of staff with a low level security clearance from performing collection operations of the counterfeit banknotes, namely a need to suppress removal of the upper section cassette 152, due to issues related to the handling of banknotes in the financial institution.

Accordingly, in the banknote deposit/withdrawal device 110, the vertical conveyance section 151 is attached at the very rear end of the upper section unit 115, and the upper section cassette 152 is disposed at the front side of the vertical conveyance section 151. Accordingly, in the banknote deposit/withdrawal device 110, in a state in which the upper section unit 115 is stored inside the banknote deposit/withdrawal device casing 11, the vertical conveyance section 151 can be made to function as a suppressing member. Accordingly, in the banknote deposit/withdrawal device 110, access to the upper section cassette 152 from the rear, namely touching and removal of the upper section cassette 152, or the removal of counterfeit notes or the like from inside the upper section cassette 152, may be suppressed.

Conversely, in the banknote deposit/withdrawal device 110, a member of staff with a high level security clearance who is in possession of the second key K2 may easily remove the upper section cassette 152 simply by lifting the upper section cassette 152 upward, as long as the upper section unit 115 is in a state pulled out of the banknote deposit/withdrawal device casing 11 toward the rear.

Namely, in the banknote deposit/withdrawal device 110, the upper section cassette 152 is disposed at the front side of the vertical conveyance section 151 in the upper section unit 115 provided with the second lock L2. Accordingly, it is possible to achieve both a high level of security for banknotes such as stored counterfeit notes, and simplicity in correction operation of banknotes.

The banknote deposit/withdrawal device 110 moreover exhibits similar operation and advantageous effects to those of the banknote deposit/withdrawal device 10 according to the first exemplary embodiment in other respects.

According to the above configuration, in the banknote deposit/withdrawal device 110 according to the third exemplary embodiment, the upper section storage box 126 is provided at the very rear end of the upper section unit 115 provided with the second lock L2. In the upper section storage box 126, the vertical conveyance section 151 on the rear side is attached to the upper section unit 115, and the upper section cassette 152 is disposed at the front side of the vertical conveyance section 151. Accordingly in the banknote deposit/withdrawal device 110, access to the upper section cassette 152 from the rear may be suppressed in a state in which the upper section unit 115 is stowed inside the banknote deposit/withdrawal device casing 11, and the upper section cassette 152 may easily be removed when the upper section unit 115 is in the pulled out state.

4. Fourth Exemplary Embodiment

An ATM 201 (FIG. 1) according to a fourth exemplary embodiment differs from the ATM 1 according to the first exemplary embodiment in the point that it includes a banknote deposit/withdrawal device 210 in place of the banknote deposit/withdrawal device 10, but is configured similarly in other respects.

Figure 11:
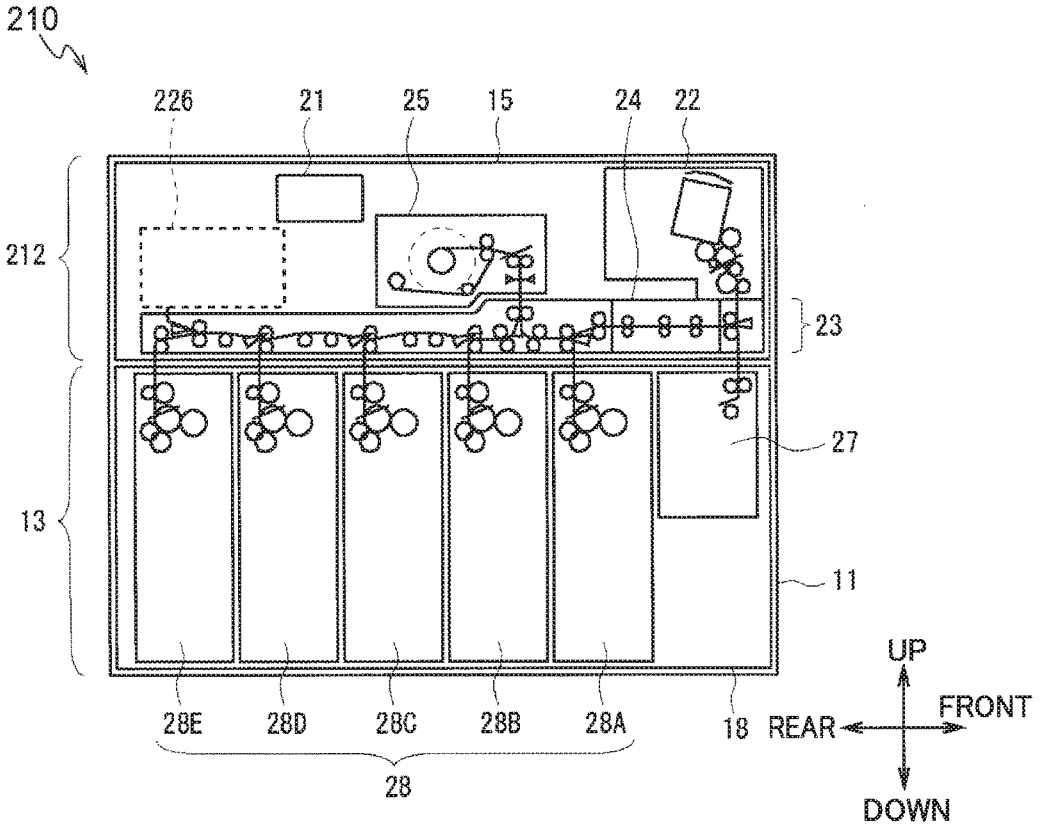
FIG. 11 is a schematic view illustrating configuration of a banknote deposit/withdrawal device according to a third exemplary embodiment.

As illustrated in FIG. 11, corresponding to FIG. 3, the banknote deposit/withdrawal device 210 differs from the banknote deposit/withdrawal device 10 in the point that it includes an upper section block 212 in place of the upper section block 12. However, a banknote deposit/withdrawal device casing 11 and a lower section block 13 are configured similarly to those of the banknote deposit/withdrawal device 10.

The upper section block 212 differs from the upper section block 12 (FIG. 3) according to the first exemplary embodiment in the point that it includes an attachment section 226 in place of the upper section storage box 26, but is configured similarly in other respects.

The attachment section 226 is provided at a position corresponding to the upper section storage box 26 (FIG. 3) of the first exemplary embodiment. Accordingly, the attachment section 226 is connected to a conveyance path branching from the switching section 37 (FIG. 5) inside the rear conveyance section 23B, similarly to the upper section storage box 26.

Figure 12:
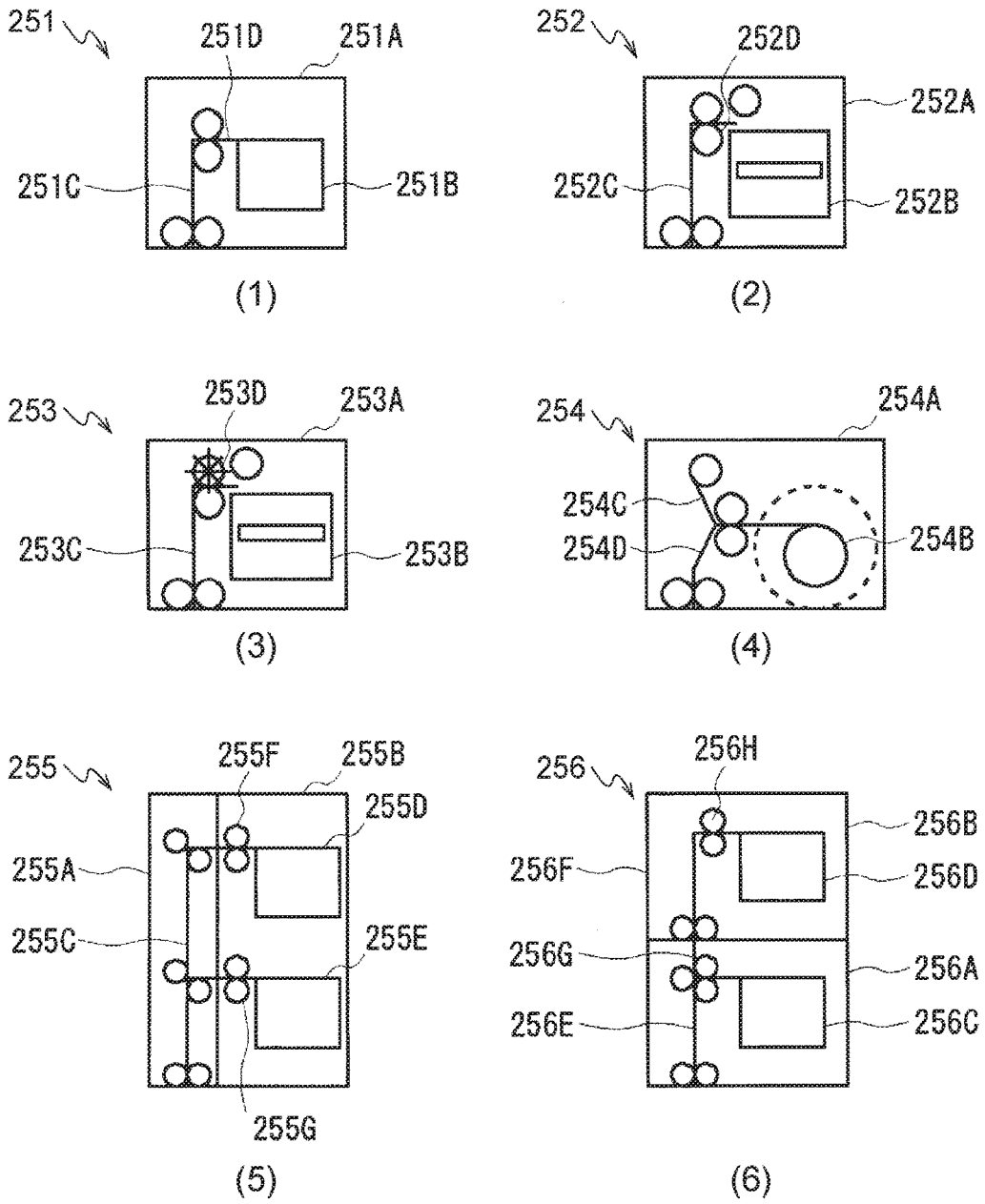
FIG. 12 is a schematic view illustrating configuration of respective modules according to the third exemplary embodiment.

As illustrated in FIGS. 12 (1) to (6), any one of plural types of module, including a deposit box 251, a withdrawal box 252, a deposit/withdrawal box 253, a temporary holding box 254, a separating-cassette type deposit box 255, or an upper/lower-separating type deposit box 256, can be attached to the attachment section 226. Namely, the attachment section 226 can be interchangeably mounted with different types of module.

The attachment section 226 is configured by a space for housing the module, a fixing member for fixing the module, and wiring members, contact connectors, and the like for making electrical connections to the module.

The deposit box 251 (FIG. 12 (1)) is configured similarly to the upper section storage box 26 (FIG. 5) according to the first exemplary embodiment. Namely, the deposit box 251 is configured by a frame 251A that covers the outer periphery of the deposit box 251, a storage space 251B in which banknotes are stored, a conveyance section 251C that conveys banknotes, and a discharge mechanism 251D that discharges banknotes into the storage space 251B. Namely, the deposit box 251 has a deposit function of storing conveyed banknotes in the storage space 251B, but does not have a withdrawal function of feeding out banknotes stored in the storage space 251B.

Similarly to in the first exemplary embodiment, the deposit box 251 is employed as a counterfeit note box that stores banknotes determined to be counterfeit notes, or is employed as, for example, a reject box that stores reject banknotes, or a forgotten banknote storage box that takes in and stores banknotes that a user has forgotten to take in a deposit transaction or a withdrawal transaction.

The withdrawal box 252 (FIG. 12 (2)) is configured by a frame 252A that covers the outer periphery of the withdrawal box 252, a storage space 252B in which banknotes are stored, a conveyance section 252C that conveys banknotes, and a separating mechanism 252D that separates and feeds out banknotes from inside the storage space 252B one note at a time. Namely, the withdrawal box 252 has a withdrawal function, but does not have a deposit function, conversely to the deposit box 251. The withdrawal box 252 stores banknotes for withdrawal in a withdrawal transaction, for example.

The deposit/withdrawal box 253 (FIG. 12 (3)) is configured by a frame 253A that covers the outer periphery of the deposit/withdrawal box 253, a storage space 253B in which banknotes are stored, a conveyance section 253C that conveys banknotes, and a separating and discharging mechanism 253D that discharges banknotes and stacks the banknotes in the storage space 253B, and that separates and feeds out banknotes from the storage space 253B one note at a time. Namely, similarly to the upper section storage box 26 and the banknote storage boxes 28 (FIG. 3) according to the second exemplary embodiment, the deposit/withdrawal box 253 has a banknote deposit function and a banknote withdrawal function. Similarly to the banknote storage boxes 28, for example, the deposit/withdrawal box 253 stores banknotes handled in deposit transactions and withdrawal transactions.

The temporary holding box 254 (FIG. 12 (4)) is configured similarly to the temporary holding section 25 (FIG. 3), and includes a frame 254A that covers the outer periphery of the temporary holding box 254, a rotating drum 254B configured in a circular cylinder shape, a tape 254C that wraps around a circumferential side face of the drum, and a conveyance mechanism 254D that conveys banknotes. Namely, the temporary holding box 254 can achieve both a deposit function and a withdrawal function by wrapping and storing conveyed banknotes around the periphery of the rotating drum 254B, and peeling away and feeding out banknotes from the periphery of the rotating drum 254B. Similarly to the temporary holding section 25, for example, the temporary holding box 254 temporarily store banknotes paid in by a user during a deposit transaction.

The separating-cassette type deposit box 255 (FIG. 12 (5)) is configured such that a vertical conveyance section 255A on a rear side and a storage cassette 255B on a front side can be easily removed, similarly to the upper section storage box 126 in the second exemplary embodiment. A conveyance mechanism 255C that conveys banknotes primarily in the up-down direction is incorporated inside the vertical conveyance section 255A. Two storage spaces 255D and 255E are disposed one above the other in the up-down direction inside the storage cassette 255B. Discharge mechanisms 255F and 255G that discharge banknotes into the storage spaces 255D and 255E are also provided ahead of the storage spaces 255D and 255E. The separating-cassette type deposit box 255 is capable of, for example, storing reject banknotes in one storage space 255D, and storing counterfeit notes in the other storage space 255E.

The upper/lower-separating type deposit box 256 (FIG. 12 (6)) has a configuration resembling two of the deposit boxes 251 (FIG. 12 (1)) stacked in the up-down direction. Namely, the upper/lower-separating type deposit box 256 is configured by frames 256A and 256B that cover the outer periphery of the upper/lower-separating type deposit box 256, storage spaces 256C and 256D in which banknotes are stored, conveyance sections 256E and 256F that convey banknotes, and discharge mechanisms 256G and 256H that discharge banknotes into the respective storage spaces 256C and 256D. The conveyance section 256E also includes a switching mechanism that switches the conveyance destination of a banknote to either the discharge mechanism 256G or the conveyance section 256F. The upper/lower-separating type deposit box 256 is capable of, for example, storing reject banknotes in one storage space 256C, and storing counterfeit notes in the other storage space 256D, similarly to the separating-cassette type deposit box 255.

In the banknote deposit/withdrawal device 210 according to the fourth exemplary embodiment configured as described above, the attachment section 226 is provided at the rear end of the upper section unit 15, and is connected to the banknote conveyance path through the switching section 37 of the rear conveyance section 23B. One module, such as the deposit box 251, selected from plural types of module is connected to the attachment section 226.

Accordingly, the banknote deposit/withdrawal device 210 enables modules to be employed for various purposes corresponding to the type of module attached to the attachment section 226.

In particular, there is no limitation to a module such as the deposit box 251 that has only the one storage space 251B, and modules with two mutually independent storage spaces, such as the separating-cassette type deposit box 255 or the upper/lower-separating type deposit box 256, may be attached to the attachment section 226. In such cases, in the banknote deposit/withdrawal device 210, although there is only a single conveyance path connected to the attachment section 226 in the rear conveyance section 23B, branching the conveyance path within the respective modules enables banknotes to be conveyed to an appropriate conveyance destination.

Accordingly, in the banknote deposit/withdrawal device 210, in a case in which, for example, it is desirable to store a comparatively large number of banknotes of a single type, the deposit box 251 may be attached to the attachment section 226. Further, in a case in which it is desirable to store two types of banknotes separately and in comparatively small numbers, the separating-cassette type deposit box 255 or the upper/lower-separating type deposit box 256 may be attached to the attachment section 226.

In particular, in the separating-cassette type deposit box 255 and the upper/lower-separating type deposit box 256, conveyance paths running in the up-down direction are formed inside the respective modules. Accordingly, these modules may be regarded as modules that extend the conveyance path in the rear conveyance section 23B and that provide plural additional storage boxes joined to the extended conveyance path.

In the banknote deposit/withdrawal device 210, the type of module to be attached to the attachment section 226 is chosen according to, for example, the wishes of the financial institution in which it will be installed, and the chosen module is attached during the manufacturing process. Thus, in the manufacturing process of the banknote deposit/withdrawal device 210, sections other than the attachment section 226 may be manufactured in the same manner regardless of the type of module that is to be attached to the attachment section 226, enabling common components and manufacturing procedures, and thereby enabling greater efficiency and a reduction in costs to be achieved across a variety of operations.

Moreover, the banknote deposit/withdrawal device 210 exhibits similar operation and advantageous effects to those of the banknote deposit/withdrawal device 10 according to the first exemplary embodiment in other respects.

According to the configuration described above, in the banknote deposit/withdrawal device 210 according to the fourth exemplary embodiment, the attachment section 226 is provided in the upper section block 212, and a module selected from out of various types of module, such as the deposit box 251, is attached to the attachment section 226. Accordingly, the banknote deposit/withdrawal device 210 may enable different types of module to be attached without modifying the configuration of the conveyance section 23 and the like in the upper section block 212, and may enable banknotes to be stored in the module separately to the respective banknotes stored in the banknote storage boxes 28.

5. Other Exemplary Embodiments

Note that, in the first exemplary embodiment described above, explanation has been given regarding a case in which the upper section storage box 26 is disposed at the rear end of the upper section block 12. However, the present invention is not limited thereto. The upper section storage box 26 may be disposed at an intermediate location or a location toward the front of the upper section block 12, for example further to the front side than the temporary holding section 25. In such cases, in the rear conveyance section 23B, the position of the switching section 37 that switches the conveyance path of banknotes destined for the upper section storage box 26 is not limited to the furthest location from the verification section 24, namely further than the switching section 36 from the verification section 24, and may be closer than the switching section 36 to the verification section 24, or may be closer than the switching section 33 to the verification section 24. Similar also applies to the second to the fourth exemplary embodiments.

In the first exemplary embodiment described above, explanation has been given regarding a case in which the temporary holding section 25 is provided, and the switching section 33 is provided within the rear conveyance section 23B of the conveyance section 23. However, the present invention is not limited thereto, and, for example, the temporary holding section 25 and the switching section 33 may be omitted. In such cases, the ATM 1 may be made to function as a withdrawal only device, referred to as a cash dispenser. In such cases, rather than counterfeit notes, the upper section storage box 26 may be employed as a forgotten banknote storage box for storing banknotes forgotten by a customer. Similar also applies to the second to the fourth exemplary embodiments.

In the first exemplary embodiment described above, explanation has been given regarding a case in which deposit reject banknotes are retained in the conveyance path of the rear conveyance section 23B. However, the present invention is not limited thereto. For example, each time there is a deposit reject banknote, the deposit reject banknote may be conveyed to the deposit/withdrawal section 22 and returned to the customer. In such cases, since banknotes are not being retained in the rear conveyance section 23B, banknotes determined to be counterfeit notes can be conveyed to the upper section storage box 26 and stored without being conveyed to the temporary holding section 25.

In the third exemplary embodiment described above, explanation has been given regarding a case in which the upper section storage box 126 is configured by the vertical conveyance section 151 and the upper section cassette 152. Further, the vertical conveyance section 151 is provided at the rear end of the upper section unit 115, and the upper section cassette 152 disposed at the front side of the vertical conveyance section 151 is removed by being lifted upward. However, the present invention is not limited thereto. The upper section cassette 152 may be removed by being moved in various directions other than the rear direction, this being the direction in which the upper section unit 15 is pulled out.

Figure 13:
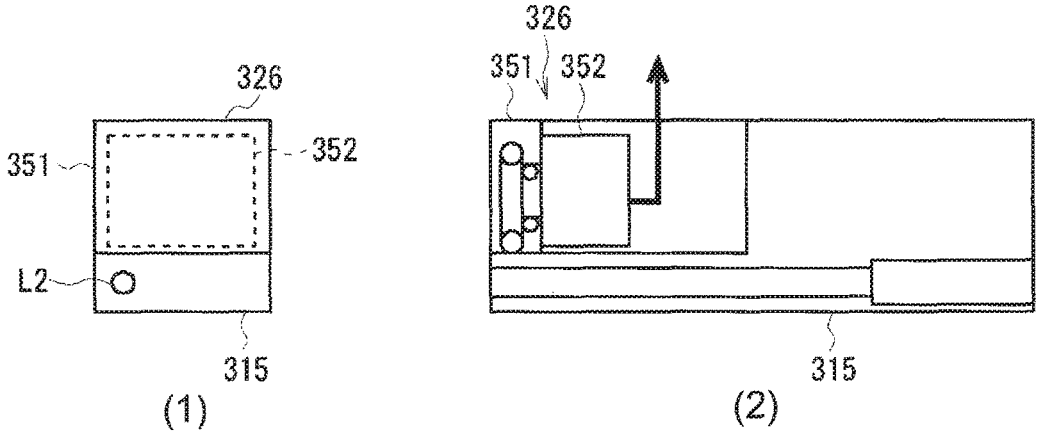
FIG. 13 is a schematic view illustrating removal of an upper section cassette according to an alternative exemplary embodiment.

For example, as illustrated in FIG. 13 corresponding to FIG. 10, an upper section storage box 326 may be configured by a vertical conveyance section 351 and an upper section cassette 352. The vertical conveyance section 351 may be provided at a rear end of an upper section unit 315, and the upper section cassette 352 disposed at the front side of the vertical conveyance section 351 may be removed by being moved toward the left or toward the right.

Figure 14:
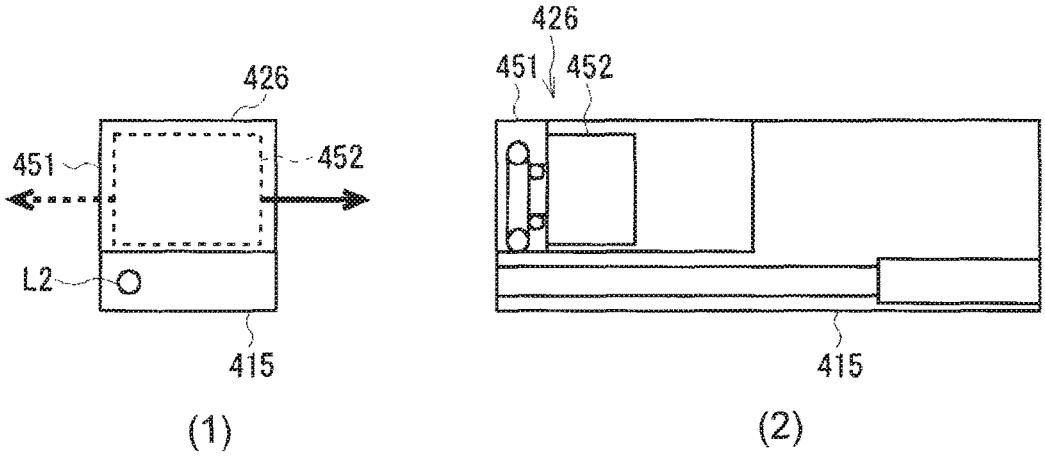
FIG. 14 is a schematic view illustrating removal of an upper section cassette according to an alternative exemplary embodiment.

Alternatively, as illustrated in FIG. 14, for example, an upper section storage box 426 may be configured by a vertical conveyance section 451 and an upper section cassette 452. The vertical conveyance section 451 may be attached to a rear end of an upper section unit 415, and the upper section cassette 452 disposed at the front side of the vertical conveyance section 451 may be removed by being moved toward the left or toward the right, and then being lifted upward.

Figure 15:
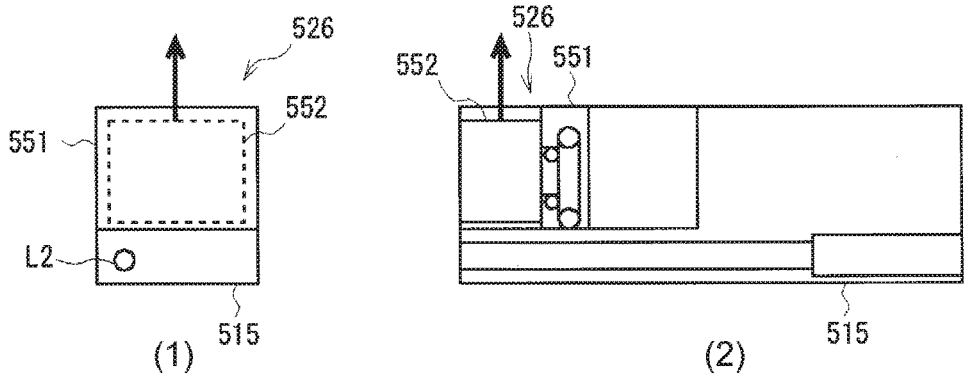
FIG. 15 is a schematic view illustrating removal of an upper section cassette according to an alternative exemplary embodiment.

Moreover, as illustrated in FIG. 15, an upper section storage box 526 may be configured by a vertical conveyance section 551 and an upper section cassette 552. The vertical conveyance section 551 may be attached slightly further toward the front than a rear end of an upper section unit 515, and the upper section cassette 552 disposed to the rear side of the vertical conveyance section 551 may be removed by being moved upward. In such cases, when the upper section unit 515 is in a stowed state inside the banknote deposit/withdrawal device casing 11, although the upper section cassette 552 is exposed at a rear face, the upper section cassette 552 cannot be moved upward, thereby enabling removal of the upper section cassette 552 or the extraction of reject banknotes to be prevented.

Figure 16:
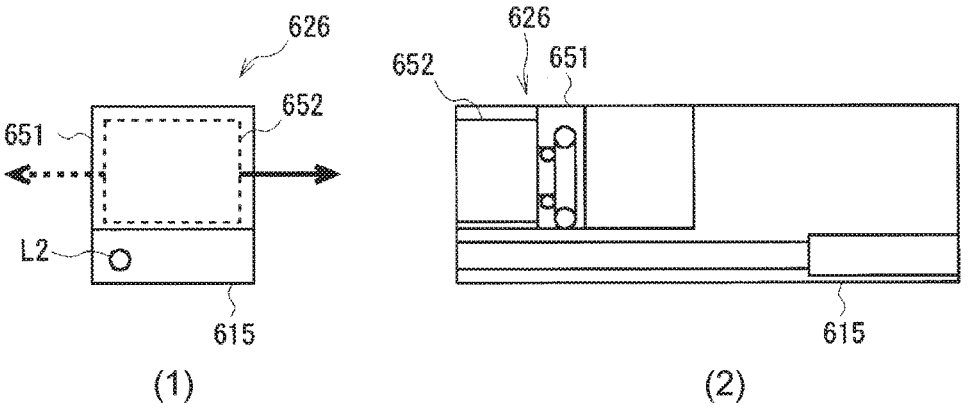
FIG. 16 is a schematic view illustrating removal of an upper section cassette according to alternative exemplary embodiment.

As illustrated in FIG. 16, an upper section storage box 626 may be configured by a vertical conveyance section 651 and an upper section cassette 652. The vertical conveyance section 651 may be attached slightly further toward the front than a rear end of an upper section unit 615, and the upper section cassette 652 disposed at the rear side of the vertical conveyance section 651 may be removed by being moved toward the left or toward the right.

Figure 17:
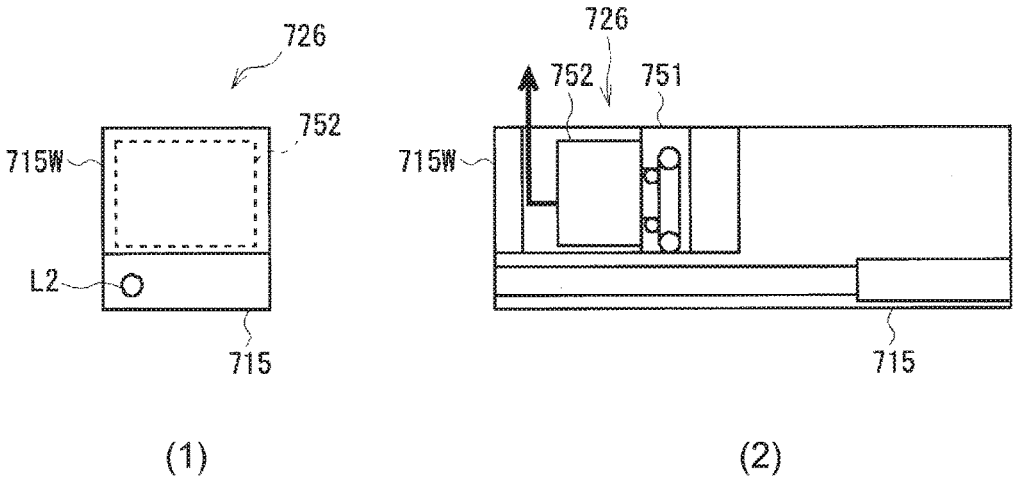
FIG. 17 is a schematic view illustrating removal of an upper section cassette according to alternative exemplary embodiment.

Moreover, as illustrated in FIG. 17, an upper section storage box 726 may be configured by a vertical conveyance section 751 and an upper section cassette 752. A protective plate 715W may be provided at a rear end of an upper section unit 715, and the vertical conveyance section 751 may be attached further to the front side than the protective plate 715W. The upper section cassette 752 disposed at the rear side of the vertical conveyance section 751 may be removed by being moved toward the rear and then lifted upward.

In the fourth exemplary embodiment described above, explanation has been given regarding a case in which only a single attachment section 226 is provided inside the upper section block 212. However, the present invention is not limited thereto. Two or more of the attachment sections 226 may be provided inside the upper section block 212. In such cases, switching sections similar to the switching section 37 may be added inside the rear conveyance section 23B at positions corresponding to the attachment sections 226.

The present invention is not limited to the respective exemplary embodiments described above nor to the other exemplary embodiments described above. Namely, the present invention encompasses application to exemplary embodiments appropriately combining some or all of the respective exemplary embodiments described above and the other exemplary embodiments described above, and exemplary embodiments deriving from elements thereof.

Moreover, in the first exemplary embodiment described above, explanation has been given regarding case in which the banknote deposit/withdrawal device 10 serving as a medium processing device is configured by the deposit/withdrawal section 22 serving as an input/output section, the front conveyance section 23A serving as a first conveyance section, the verification section 24 serving as a verification section, the rear conveyance section 23B serving as a second conveyance section, the switching sections 32, 34, 35, and 36 serving as storage switching sections, the banknote storage boxes 28 serving as medium storage boxes, the switching section 37 serving as a segregation switching section, the upper section storage box 26 serving as a segregation storage box, and the banknote controller 21 serving as a controller.

However, the present invention is not limited thereto, and a medium processing device may be configured by input/output sections, first conveyance sections, verification sections, second conveyance sections, storage switching sections, medium storage boxes, segregation switching sections, segregation storage boxes, and controllers of various other configurations.

Moreover, in the first exemplary embodiment described above, explanation has been given regarding case in which the banknote deposit/withdrawal device 10 serving as a medium processing device is configured by the deposit/withdrawal section 22 serving as an input/output section, the front conveyance section 23A serving as a first conveyance section, the verification section 24 serving as a verification section, the rear conveyance section 23B serving as a second conveyance section, the switching sections 32, 34, 35, and 36 serving as storage switching sections, the switching section 33 serving as a temporary holding switching section, the banknote storage boxes 28 serving as medium storage boxes, the switching section 37 serving as a segregation switching section, the upper section storage box 26 serving as a segregation storage box, and the banknote controller 21 serving as a controller.

However, the present invention is not limited thereto, and a medium processing device may be configured by input/output sections, first conveyance sections, verification sections, second conveyance sections, storage switching sections, the temporary holding switching sections, medium storage boxes, segregation switching sections, segregation storage boxes, and controllers of various other configurations.

The disclosure of Japanese Patent Application No. 2014-185323 is incorporated in its entirety by reference herein.

All cited documents, patent applications, and technical standards mentioned in the present specification are incorporated by reference in the present specification to the same extent as if the individual cited document, patent application, or technical standard was specifically and individually indicated to be incorporated by reference.

INDUSTRIAL APPLICABILITY

The present invention may be employed as an Automatic Teller Machine or the like, that performs transaction processing relating to deposit and withdrawal of banknotes with a customer.

The invention claimed is:

1. A medium processing device, comprising:

an input/output section that inputs and outputs a paper sheet shaped medium;

a first conveyance section, connected to the input/output section, that conveys the medium along a first conveyance path;

a verification section that includes first and second ends, and an internal verification conveyance section to convey the medium between the first and second ends, the internal verification conveyance section being connected to the first conveyance section at the first end, and verifying the medium conveyed by the verification conveyance section;

a second conveyance section, connected to the second end of the verification conveyance section, and that conveys the medium along a second conveyance path;

a plurality of switching sections, provided at the second conveyance section, at least one of the switching sections being a storage switching section, and at least one of the switching sections being a segregation switching section, the switching sections switching a conveyance path of the medium;

a medium storage box, connected to the second conveyance section via the storage switching section, that stores the medium;

a segregation storage box, connected to the second conveyance section via the segregation switching section, that stores a segregated medium determined by the verification section to be a medium that should be segregated from the medium stored in the medium storage box; and a controller that controls a conveyance path of the medium by the first conveyance section and the second conveyance section by using a verification result of the verification section, wherein the segregation switching section is positioned farther than the storage switching section with respect to the verification section on the second conveyance path.

2. The medium processing device of claim 1, further comprising:

a temporary holding switching section, provided at the second conveyance section, that switches the medium conveyance path; and a temporary holding section, connected to the second conveyance section through the temporary holding switching section, that temporarily stores the medium, wherein the segregation switching section is positioned farther than the temporary holding switching section with respect to the verification section on the second conveyance path.

3. The medium processing device of claim 2, wherein the controller, among the medium inserted into the input/output section, conveys any of the medium that has been verified as genuine in the verification section to the temporary holding section to be stored, and conveys any of the medium that has been verified as non-genuine in the verification section to the segregation storage box to be stored.

4. A medium transaction device, comprising:

a casing that includes an opening;

a door that opens and closes the opening of the casing;

a movable unit that is stowed inside the casing or is movable to allow the movable unit to be pulled out through the opening to the exterior;

an input/output section, provided at the movable unit, that inputs and outputs a paper sheet shaped medium;

a first conveyance section, provided at the movable unit, that is connected to the input/output section, and that conveys the medium along a first conveyance path; a verification section, provided at the movable unit, that includes an internal verification conveyance section to convey the medium between both ends of the verification section, that is connected to the first conveyance section at one end of the verification conveyance section, and that verifies the medium conveyed by the verification conveyance section;

a second conveyance section, provided at the movable unit, that is connected to another end of the verification conveyance section, and that conveys the medium along a second conveyance path;

a storage switching section, provided at the second conveyance section, that switches a conveyance path of the medium;

a medium storage box, connected to the second conveyance section via the storage switching section, that stores the medium;

a segregation switching section, provided at the second conveyance section, that switches a conveyance path of the medium;

a segregation storage box, provided at the movable unit, that is connected to the second conveyance section via the segregation switching section, and that stores a segregated medium verified by the verification section as requiring segregation from the medium stored in the medium storage box; and a controller that controls a conveyance path of the medium by the first conveyance section and the second conveyance section by using a verification result of the verification section; and a removal suppressing section that suppresses the segregation storage box from being removed from the movable unit, and that faces the opening in a state in which the movable unit is stowed inside the casing, wherein the segregation storage box is detachably attached to the movable unit, and is suppressed from being separated from the movable unit in a state in which the movable unit is stowed inside the casing, wherein the segregation storage box is suppressed from being removed from the movable unit by the removal suppressing section.

5. The medium transaction device of claim 4, wherein the removal suppressing section is a segregation conveyance section that conveys the medium.

6. The medium transaction device of claim 4, wherein the segregation storage box is removed from the movable unit by being displaced with respect to the movable unit in a different direction that is not the same as a pull-out direction in which the movable unit is pulled out from inside the casing to the exterior.

7. The medium transaction device of claim 4, wherein the controller conveys the medium to the segregation storage box to be stored when the medium has been verified by the verification section as unsuitable for re-use.

8. The medium transaction device of claim 4, wherein the removal suppressing section is a protective plate.

* * * * *